US012290718B2

(12) United States Patent
Alba

(10) Patent No.: US 12,290,718 B2
(45) Date of Patent: May 6, 2025

(54) BENDABLE EXERCISE BAR

(71) Applicants: Robert L. Alba, Bethpage, NY (US); Louis Alba, Bethpage, NY (US)

(72) Inventor: Robert L. Alba, Phoenixville, PA (US)

(73) Assignee: BENDY FIT, INC.

( * ) Notice: Subject to any disclaimer, the term of this patent is extended or adjusted under 35 U.S.C. 154(b) by 0 days.

(21) Appl. No.: 17/827,028

(22) Filed: May 27, 2022

(65) Prior Publication Data

US 2022/0288459 A1 Sep. 15, 2022

Related U.S. Application Data

(63) Continuation of application No. 17/318,793, filed on May 12, 2021, now Pat. No. 11,534,660.

(60) Provisional application No. 62/704,501, filed on May 13, 2020.

(51) Int. Cl.

| | |
|---|---|
| ***A63B 24/00*** | (2006.01) |
| ***A63B 21/00*** | (2006.01) |
| ***A63B 21/018*** | (2006.01) |

(52) U.S. Cl.

CPC ..... *A63B 24/0062* (2013.01); *A63B 21/018* (2013.01); *A63B 21/4035* (2015.10); *A63B 2024/0065* (2013.01); *A63B 2220/17* (2013.01); *A63B 2220/58* (2013.01); *A63B 2225/02* (2013.01); *A63B 2225/74* (2020.08); *A63B 2230/75* (2013.01)

(58) Field of Classification Search

CPC ..... A63B 21/018; A63B 21/4035; A63B 24/0062; A63B 2024/0065; A63B 2220/17; A63B 2220/58; A63B 2225/02; A63B 2225/74; A63B 2230/75

See application file for complete search history.

(56) References Cited

U.S. PATENT DOCUMENTS

| | | | | |
|---|---|---|---|---|
| 5,004,226 A * | 4/1991 | Brown, Jr. | A63B 21/045 482/906 |
| 5,514,055 A * | 5/1996 | Elliott | A63B 21/045 482/121 |
| 5,891,003 A * | 4/1999 | Deac | A63B 5/16 482/106 |
| 6,293,893 B1 * | 9/2001 | Truchelut | A63B 21/002 482/121 |
| 6,775,566 B2 * | 8/2004 | Nissila | A61B 5/257 600/382 |
| 7,704,198 B2 * | 4/2010 | Brown, Jr. | A63B 21/026 482/121 |
| 9,610,470 B1 | 4/2017 | Eshet | |
| 9,700,480 B2 * | 7/2017 | Fiore | A61H 15/0092 |

(Continued)

FOREIGN PATENT DOCUMENTS

KR 200454778 Y1 7/2011

OTHER PUBLICATIONS

Partial Supplementary Search Report dated Apr. 30, 2024—EP Application No. 21803505.3.

*Primary Examiner* — Joshua Lee

(74) *Attorney, Agent, or Firm* — Barnes & Thornburg LLP

(57) ABSTRACT

An exercise device comprising a bendable pole with spring-like properties. The bendable pole has grips at opposing ends and in a midsection. The exercise device is configured to be used for a variety of exercise methods. The exercise device provides personal fitness tracking in conjunction with a mobile software application.

16 Claims, 33 Drawing Sheets

(56) References Cited

U.S. PATENT DOCUMENTS

| | | | | |
|---|---|---|---|---|
| 9,925,406 | B2 * | 3/2018 | Brown | A63B 21/0724 |
| 2004/0082449 | A1 * | 4/2004 | Brown, Jr. | A63B 23/0211 482/140 |
| 2005/0079962 | A1 * | 4/2005 | Brown | A63B 21/028 482/121 |
| 2005/0202944 | A1 * | 9/2005 | Deal | A63B 21/0004 482/121 |
| 2007/0135275 | A1 * | 6/2007 | Oates | A63B 21/0004 482/109 |
| 2009/0149304 | A1 * | 6/2009 | Smith | A63B 21/4035 482/126 |
| 2009/0176635 | A1 * | 7/2009 | Brinson | A61H 7/001 482/141 |
| 2011/0201483 | A1 * | 8/2011 | Holleman | A63B 21/4035 482/122 |
| 2013/0029811 | A1 | 1/2013 | Lando et al. | |
| 2018/0008859 | A1 | 1/2018 | Cook | |
| 2018/0272187 | A1 * | 9/2018 | Sands | A63B 24/0062 |
| 2019/0255374 | A1 * | 8/2019 | Constanza | A63B 24/0087 |

* cited by examiner

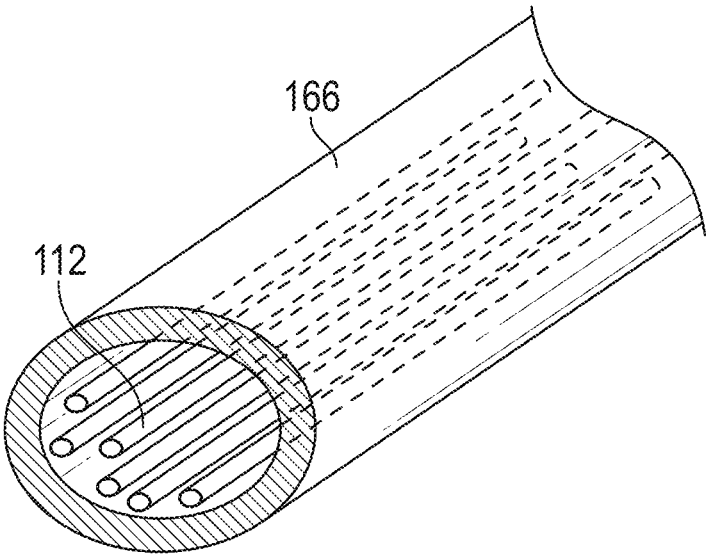
FIG. 16A1

Zero Profile

Easter Egg Profile

Elongated Profile

BENDABLE EXERCISE BAR

FIELD

This disclosure relates to exercise equipment. In particular, the disclosure relates to a flexible exercise bar, exercise method, method of manufacturing and fitness software application.

BACKGROUND

Many exercise devices provide only one mode of use targeting a limited area of the body, such as a chin-up bar. These devices may need to be supplemented by many other exercise devices or routines for a comprehensive workout. Most mechanical exercise device solutions fail to completely solve industry problems because they force the user to follow the pattern and range of motion and location of a device around that the device mechanically travels, with only some adjustment for effort and size of the user.

Existing exercise devices often are not mobile so can only be used when resident in a particular location, requiring a break in exercise routine when vacationing, for example, and the inability to choose between exercising indoors or outdoors.

What is needed is an exercise device that offers a significant quantity of practical use modalities that appear as simple and graceful forms, blending naturally and gracefully with human anatomy, is portable and safe to use.

SUMMARY

An exercise device is disclosed comprised of a flexibly bendable pole with spring-like properties that may be used for many exercise methods; isotonic, isometric, calisthenics, aerobic forms of exercise, as well as an aid for stretching, self-massage, guided meditation, wireless personal fitness tracking with mobile app integration and supports remote individual coaching and group engagement.

The exercise device provides support and controlled resistance for a range of upper extremity, shoulder, back, torso, core, and whole-body exercises, while helping a person maintain good posture and balance. It may have ergonomic hand grips at both ends and an adjustable cushion positioned in its middle. The spring rate is provided by a bundle of small diameter resilient rods which can be configured for a person's size, weight, and fitness level for specific type of use. It is also an IOT (Internet of Things) device that integrates with a fitness app to support user engagement and development of a positive fitness habit.

The exercise device may also be incorporated into various artistic and therapeutic forms of movement; including but not limited to, modern dance, group dances, accessorized for unusual or competitive sport, child's play, parade and multimedia artistic displays, and physical therapy.

The exercise device may be used in a vast number of places, including indoors or outdoors, at health clubs, at home, offices, parks, beaches, schools and doctor's offices, for example. It may be used for physiotherapy, occupational therapy, specific pre-sport or après-sport routines to help maintain flexibility, focus and tonus.

The exercise device can be accessorized with custom decorations, branding images, supportive electronics such as speakers, TOT communication, location, and force sensors, haptic feedback, responsive and programmable lighting for entertainment and cuing of the user or a group, general creative movement, and remote app and tele-video participation.

SUMMARY

An illustrative exercise device comprises of a resilient, bendable pole with spring-like properties that can be used for both isotonic and isometric forms of exercise as well as an aid for stretching and self-massage. Its use provides both support and controlled resistance for a range of upper extremity, shoulder, back, torso and core exercises. It may have ergonomic hand grips at both ends and at an adjustable position in its middle. The bending force or spring rate can be provided by a variety force generating assemblies, including for example, bundle of flexible, resilient rods or springs that can be configured for a user's size, weight, fitness level of specific type of use.

A key element of the exercise device is the assemblies that provide the characteristic spring force. Illustrative spring force or bending force assemblies include, flexible rods, spring mechanisms and other resilient mechanisms. The selection of rod section shape or shape of the core determines whether the flexion is more or less constrained to a single plane (square or rectangular/prismatic sections) or is omni directional (round sections).

End grips at either end of the pole primarily provide an ergonomically appropriate means for the user to grasp and operate the device and serve to protectively cap the rod bundle ends by connecting to the IMU (inertial measurement unit) and/or outer jacket. The end grips can also serve as housings for batteries, electronics and sensors, and provide additional weight & inertia.

An outer sleeve or spacer comprises the outer surface that the user holds, provides a means of keeping the spring force assembly intact and may also serve as a protective layer in the event that a rod or other component should break.

Areas of the exercise device, such as end grips, middle grips or center channel, may contain an additional rod or other devices or accessory elements such as sensors, lighting, wiring, batteries, other electronic components, or weights, for example. Within the device there are opportunities for embedded systems that provide additional functionality, user feedback and interactivity. The exercise device may be integrated with a fitness software application.

DESCRIPTION OF DRAWINGS

The detailed description refers to the accompanying figures, which depict illustrative embodiments, and in which include:

FIG. 9 is a block diagram of an illustrative embodiment of electronic components that may be incorporated into the exercise device, or with which the exercise device may be configured to coordinate with.

FIG. 16A1 depicts a flex-shell having flexible rods therein.

FIGS. 16A, 16B, 16C, 16D depict a flex-shell with rods within a core of various core shapes.

DETAILED DESCRIPTION OF EMBODIMENTS

The figures and descriptions provided herein may have been simplified to illustrate aspects that are relevant for an understanding of the described devices, systems, and methods, described herein while eliminating, for the purpose of clarity, other aspects that may be found in typical devices, systems, and methods. Those of ordinary skill may recognize that other elements or operations may be desirable or necessary to implement the devices, systems, and methods described herein. Because such elements and operations are well known in the art, and because they do not facilitate a better understanding of the present disclosure, a discussion of such elements and operations may not be provided herein. However, this disclosure is deemed to inherently include all such elements, variations, and modifications to the described aspects that could be implemented by those of ordinary skill in the art.

Figure 1:
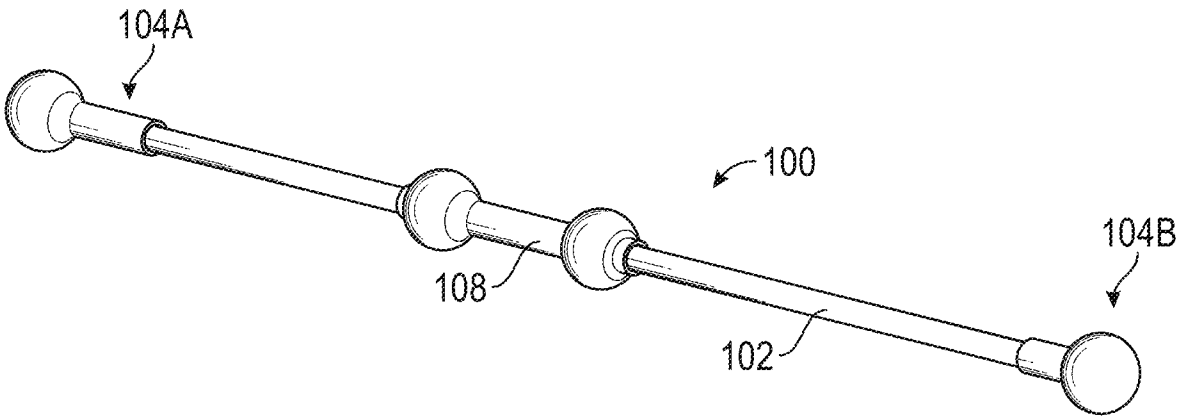
FIG. 1 depicts an illustrative embodiment of an exercise device comprising a bendable pole with spring-like qualities.

FIG. 1 depicts a schematic of an exercise device 100 to illustrate its main components. A bendable pole 102 is provided that may be bendable throughout, or over a portion of its length. A first end grip 104A and a second end grip 104B are attached to bendable pole 102 at opposing ends. First and second end grips 104A, 104B may be grasped by a user to employ exercise device 100 to perform various exercises. Exercise device 100 may also have an optional middle grip 108 disposed in a mid-section of bendable pole 102.

Numerous components will be illustrated that provide bendable pole 102 with its bendability and resiliency properties desirable for it to be used as an exercise device.

Figure 2:
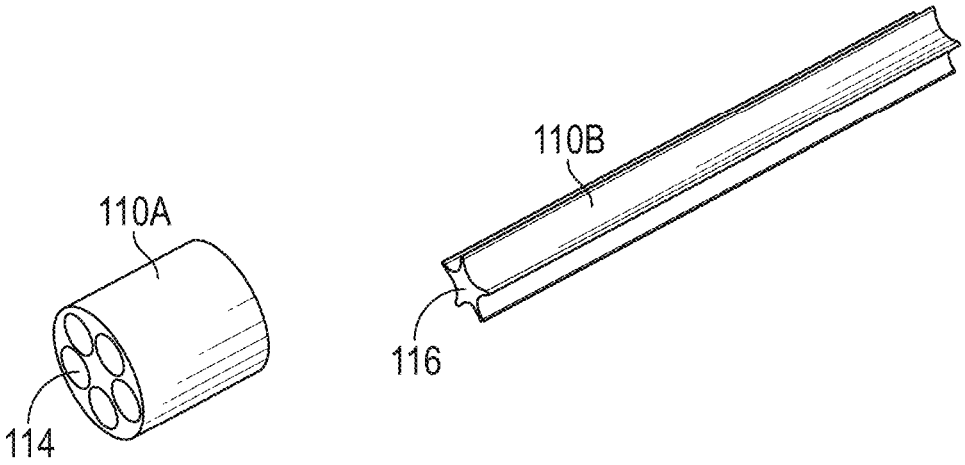
FIG. 2 depicts spacers that may be used in forming the pole portion of the exercise device.
Figure 3:
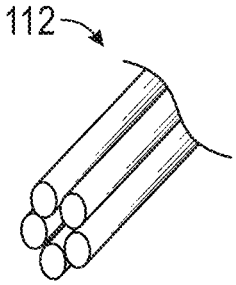
FIG. 3 depicts a bundle of rods that may be used in forming the pole portion of the exercise device.

FIG. 2 depicts spacers 110A, 110B that may be a component of bendable pole 102. More generally, spacer 110 may function to maintain an approximately cylindrical form of a bundle of rods 112 throughout a range of flexion. Rods 112 are flexible, resilient rods. An illustrative bundle of rods 112 is shown in FIG. 3. In an exemplary embodiment, spacer 110 is compliant enough to accommodate a slight flattening of the bundle of rods 112 in a mid-section of bendable pole 102 during flexion as well as permit a consistent and predictable amount of sliding friction between rods 112 during flexion.

Rods 112 may have a diameter, for example, in the range of about 0.25 inches to about 5/16 inches. An illustrative rod material is fiberglass reinforced plastic (FRP). For example, a solid material produced by a pultrusion method with a 65% by weight continuous glass roving material and 35% pultruded composites properties. Illustrative FRP properties as measured using American Standard Test Methods (ASTM) include:

ASTM D2584 65: Tensile Strength, psi×$10^3$
ASTM D3916/D638 100: Tensile Modulus, psi×$10^6$
ASTM D3916/D638 5.5: Flexural Strength, psi×$10^3$
ASTM D4476/D790 100: Flexural Modulus, psi×$10^6$
ASTM D4476/D790 5.5: Compressive Strength psi×$10^3$
ASTM D695 60: Barcol Hardness ASTM D2583 50
Izod Impact, ft.-lb./in. ASTM D256 40
Specific Gravity ASTM D792 1.9
Density, lbs./in3 ASTM D792 0.069
Water Absorption, % (weight increase after 24 hours immersion) ASTM D5700.10

Illustrative materials for spacers 110A, 110B and covering components include polyolefin, nylon, polyurethane of various durometer as a solid ranging from Shore 40 to 90 D and also used for ball-ends and ball middles bendable pole 102 coverings and PVC polyvinyl chloride.

In an illustrative embodiment, bendable pole 102 comprises a spacer 110 configured to keep a plurality of rods 112 spaced apart. Illustrative spacer 110A comprises a solid cylinder with a plurality of channels 114 disposed there through and extending the length of the spacer. Such rods may be multi-lumen tubing having a plurality of channels 114 therein. Rods 112 may be threaded through channels 114. Each of the plurality of channels 114 may have a rod 112 extending there through, or one or more channels may be left empty to accommodate other components, such as electronics, for example. The one or more channels that accommodate components other than rods 112 shall be referred to as spacer interior openings 116. Channels 114 may be uniform with respect to each other or may differ in shape and size, depending on what is threaded through channels 114. More than one rod or other components may be disposed within a single channel. Spacer 110, may have thin-walls, for example, in the range of about 0.010" to about 0.030". Spacer 110 may be of a non-uniform cross-sectional shape to provide different bending forces when bendable pole 102 is bent in difference directions. Unused channels may contain a filler. In an illustrative embodiment, spacer 110 has six equally circumferentially distributed channels for rods 112 and a seventh, central channel, for other components such as electronics.

Illustrative filler material includes polyurethane, FRP and spring steel rod fillers. These may be used to replace the location and volume of one or more rods in a bundle. Illustrative fillers include polyurethane tubing or PVC tubing of equal, or near equal size as the rod it replaces. The filler material may be easily flexible so as not to contribute to the overall flexural strength of the bending arc while in use; however, it does maintain the volume of where an FRP rod may otherwise be located. Substituting the "filler tube material" allows for lighter or heavier bending arc efforts while maintaining diameter of bendable pole 102. In other cases fillers may provide optional decorative and active features by filling the tube with materials such as glowing gel and LED lights and reflective materials like glitter.

Spacer 110 may also have the form shown as part 110B. Spacer 110B has a cross-sectional profile with a series of concave edges to accommodate rods 112 on the outside of the spacer. Spacer interior opening 116 may be hollow to accommodate an additional rod(s) 112 or other components.

Spacer 110 may be continuous along the length of bendable pole 102. In an alternative, illustrative embodiment, spacer 110 may comprise a plurality of segments. The segments may abut one another or may be strategically spaced apart along the length of bendable pole 102 to coordinate with or provide desired properties, such as maximum degree of pole flexure, or desired features conducive to various exercises. Spacer 110 may comprise segments of uniform length, or varied length. The length of spacer 110 segments may also be chosen to create or coordinate with desired properties, such as maximum degree of pole flexure, or desired features conducive to various exercises, for example.

An exemplary embodiment has six flexible rods of equal length in a hexagonal pattern, each nominally Ø5/16", round in cross-section. The bundle includes an open position in the center of the bundle that may or may not contain a seventh rod or other structure(s). Typically, the rods may be fiberglass reinforced resin, formed as a fiberglass reinforced plastic (FRP) pultrusion. The total length of the rod bundle is variable depending upon the arm span of the user, and can typically range from 36" to more than 72". In an illustrative embodiment, length is determined at time of manufacturing and is not user adjustable, however alternative embodiments include a means by which one device could be variably configured by the user to adjust to a range of lengths. The ability of rods 112 to bend sufficiently without splitting and cracking is possible because of the combination of limiting rod diameters, selecting suitable materials and assuring quality control of the rod's composition and manufacturing process.

The lubricity required for the rods to slide freely may be provided by the properties of the rod material (i.e. low friction) or spacer material, or an additional lubricant may be applied to the interior surfaces of the spacer or rods. For example, rods may be coated with PTFE, and FRP rods in groups will slide against each other by a coating of silicon gel applied during the assembly process.

Figure 4:
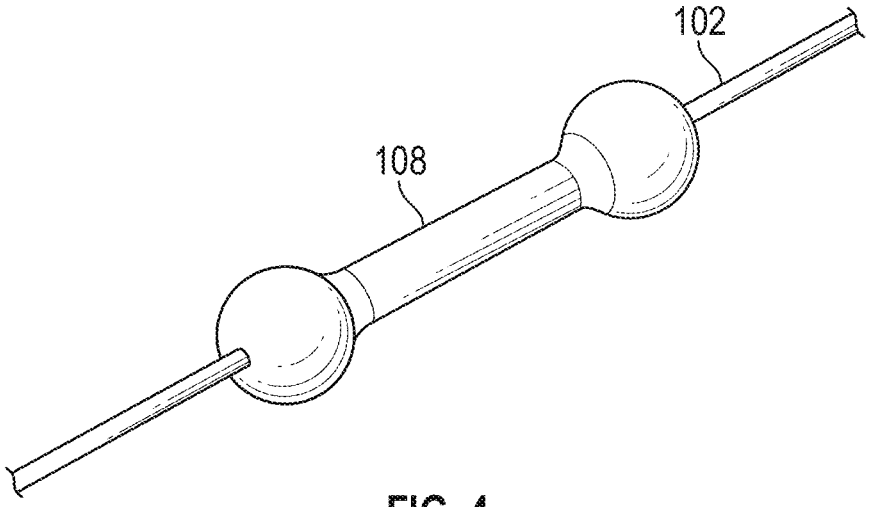
FIG. 4 depicts an illustrative embodiment of a middle grip of an exercise device.

FIG. 4 depicts an illustrative embodiment of a middle grip 108 disposed on bendable pole 102. Middle grip 108 may serve multiple functions. It may be used as an additional user's contact point or grip. It may also provide a comfortable cushion at the apex of the device's flexion, for exercises in which that portion of exercise device 100 is in contact with a user's body, such on the upper back or neck. Middle grip 108 may also serve as a locating feature on the user's back and neck to enable a user to accurately position exercise device 100 for various exercises. Additionally, middle grip 108 may act as a pressure-point massage function.

Illustrative grip materials are polyurethane integral skin foam molded balls and bar coverings. Bendable pole 102 may include coverings. Some portions of the bendable bar coverings may be solid yet pliable polyurethane 40 to 80 durometer and other bendable bar coverings may be closed cell polyurethane foam. The coverings may provide one or more of the following characteristics: water proof, nonabsorbent and UV, cleaner and body oil resistant.

In an illustrative embodiment, middle grip 108 comprises a roughly 2" ball-like form composed of a dense foam rubber or integral skin urethane molding. An illustrative range of ball diameters is about 1.5" to about 2.5". Middle grip 108 may be a single element with two ball like forms at a set distance apart, or it may consist of two identical elements in a mirrored orientation that can slideably be positioned at a range of distances apart. In a further embodiment, middle grip 108 includes two identical elements in a mirrored orientation with a central grip bendable pole portion 124 there between. Central grip bendable pole portion 124 may be a separate component onto which middle grip end portions 126A, 126B are disposed, or it may be the central portion of bendable pole 102. If a separate portion, it would be flexible to allow bending with portions of bendable pole 102 that would be disposed on either side of middle end portions 126A, 126B. Each portion of middle grip 108 may have any shape that is conducive to carrying out any or all of the functions mentioned herein.

Figure 5:
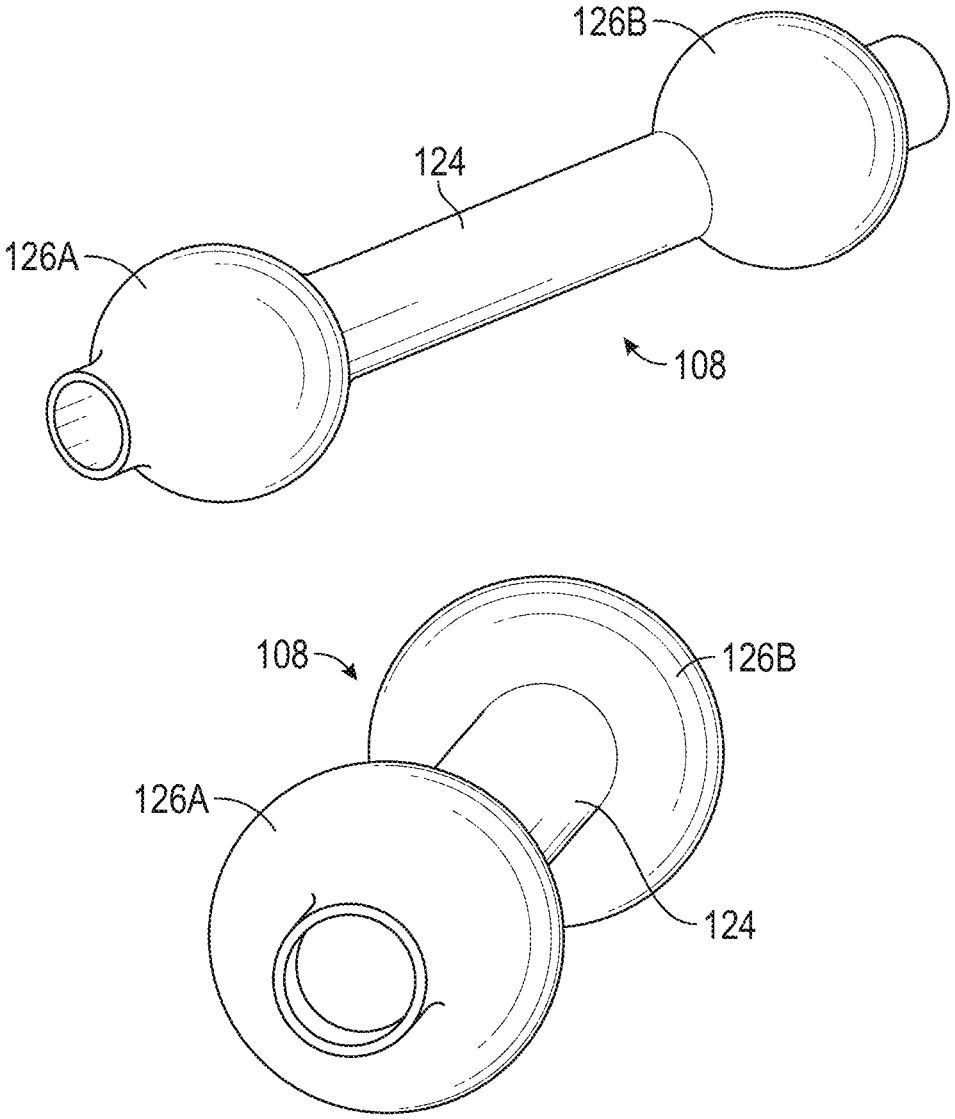
FIG. 5 depicts an illustrative middle grip.

Middle grip 108 may be adjustably attached to bendable pole 102, or may be fixedly attached thereto. In an illustrative embodiment, such as shown in FIGS. 1, 5 and 10, middle grip 108 comprises a middle grip tubular portion 124 configured to have bendable pole 102 extend therethrough, wherein middle grip tubular portion 124 has a first end and a second end. Middle grip tubular portion 124 has middle grip end portions 126A, 126B disposed at the first and second ends of the middle grip tubular portion 124, respectively. Alternatively, components analogous to end portions 126A, 126B may be disposed along bendable pole 102, without a connecting tubular portion. Tubular portion 124 may have a circular cross-sectional profile or other shape. Tubular portion 124 may be configured to have bendable pole 102 extend therethrough, or it can be a separate bendable portion of exercise device 100, 400, 500 attached to end grips 126A, 126B.

Figure 6:
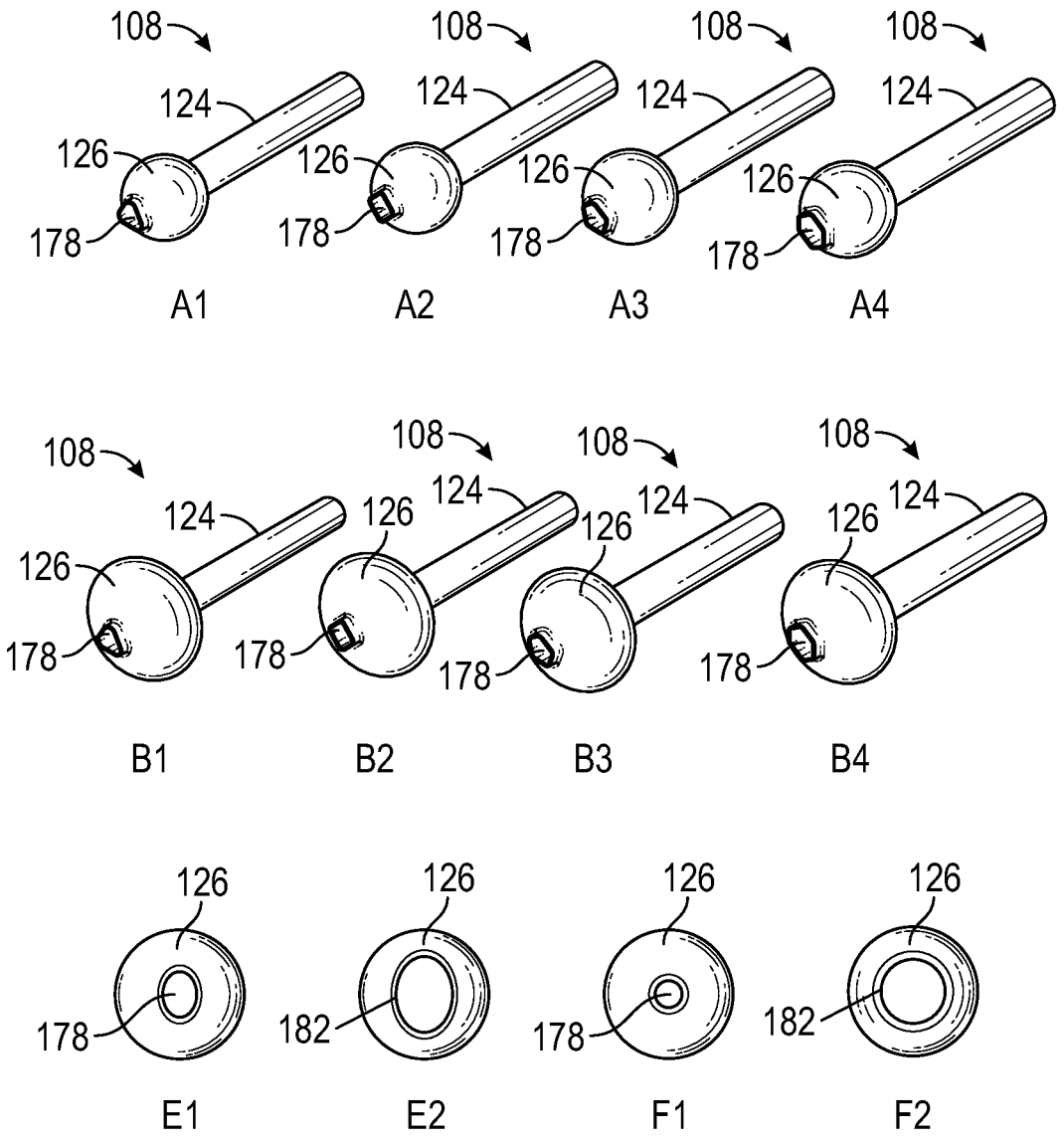
FIG. 6 depicts illustrative portions of middle grips.

FIG. 6 depicts illustrative portions of middle grips 108, which may be individual elements of exercise device 100, rather than one end of a continuous middle grip 108 such as shown in FIG. 4. Each middle grip 108 shown in FIG. 6 has a middle grip tubular portion or sleeve 124 and a middle grip end portion 126. Each middle grip 108 depicted in FIG. 6 is designed to accommodate a bendable pole 102 with a different cross-sectional profile. Each middle grip end portion 126 has a different shaped opening 178. For example, image A1 has a triangular opening 178, image A2 has a square opening 178, image A3 has a five-sided opening 178 and image A4 has a six-sided opening 178. Openings 178 may have lips 182 to provide a transition from middle grip end portions 126 to bendable pole 102. Middle grip tubular portions 124 may have openings 180 of the same shape as openings 178 in middle grip end portions 126. Openings 178, 180 may have other shapes, for example round or oval. Particular moldable materials may not need to have the specific shape of bendable pole 102, provided that the material allows middle grips 108 to adequately adhere to bendable pole 102.

Images A1, A2, A3, A4 show middle grip end portions 126 with a spherical shape. Images B1, B2, B3, B4 show end portions with round-like, but not spherical shapes. Other shapes may be used provided that they are compatible with the use of exercise device 100. Illustrative end views of middle grip 108 taken from the middle grip end portion 126 end are shown as images E1, F1. Illustrative end views of middle grip 108 taken from the middle grip tubular portion 124 end are shown as images E2, F2. Images E1, E2 depict a middle grip 108 having a round middle grip end portion 126. Images F1, F2 depict a middle grip 108 having an elongated or non-spherical middle grip end portion 126.

This may be applied for decorative purposes or to impart tactile cues for hand positioning. First middle grip end portion 126A and second middle grip end portion 126B may be constructed of textured polyurethane and integral skin molded foam.

Figure 24A:
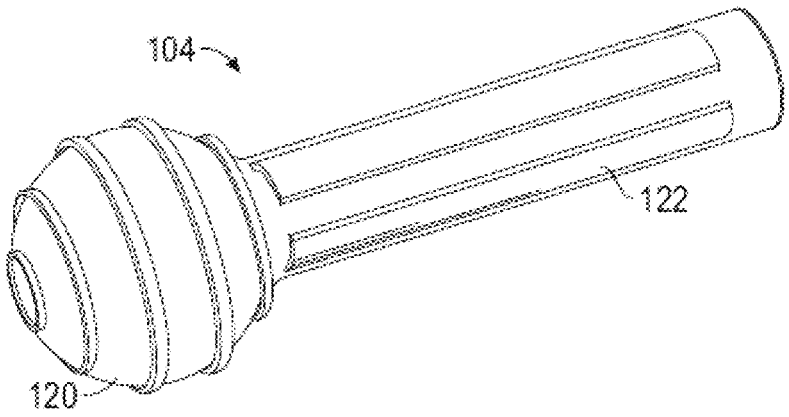
FIGS. 24A, 24B, depict textured end grips.
Figure 24B:
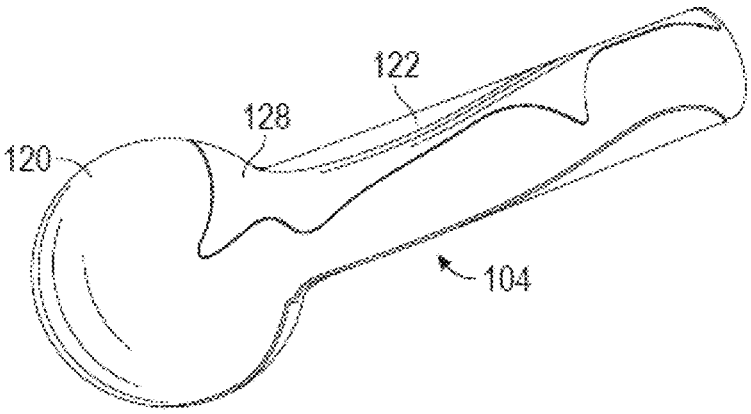
Figure 25:
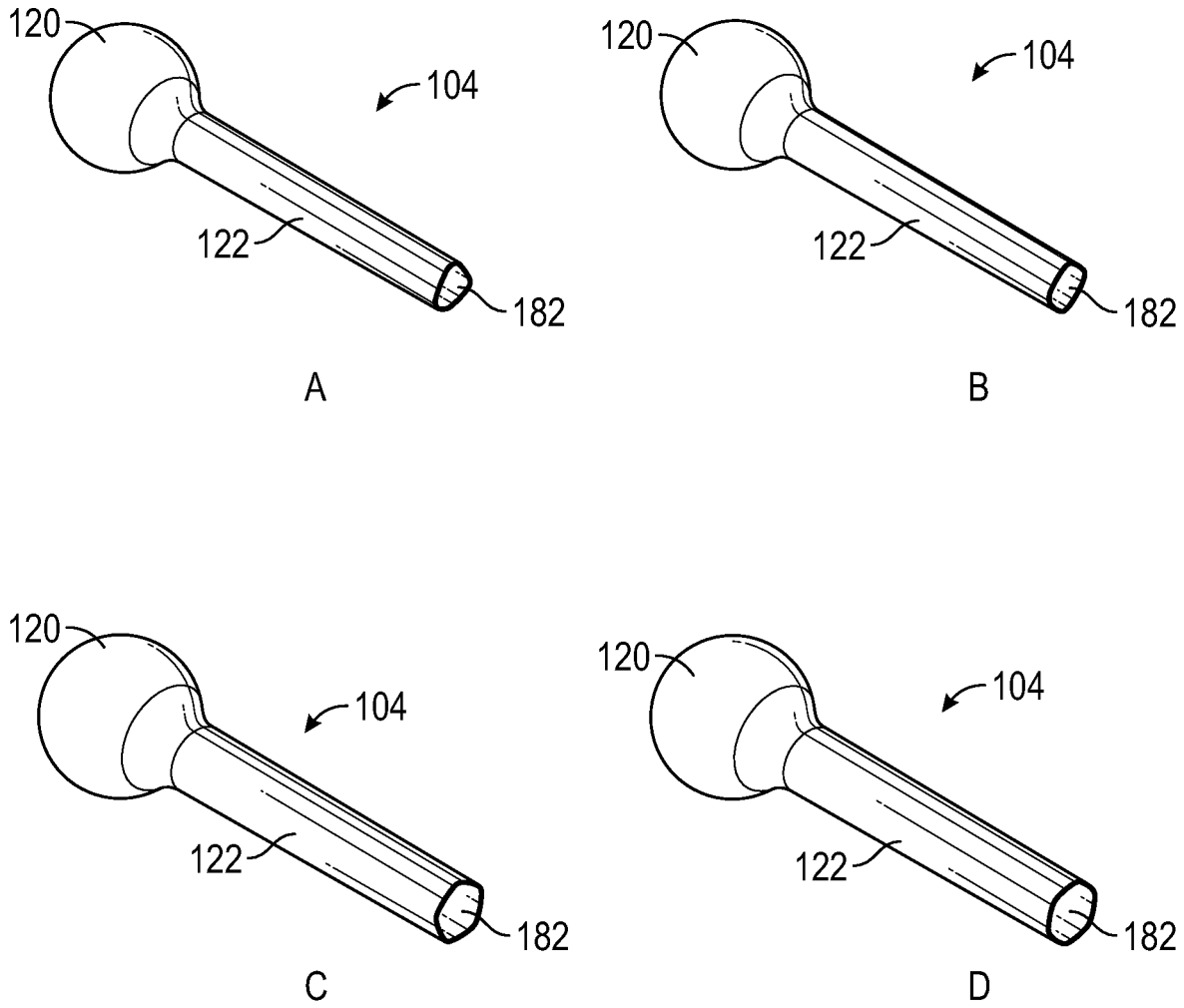
FIG. 25 depicts end grips having sleeves with multi-sides cross-sectional openings.

FIGS. 24A, 24B, 25 depict illustrative embodiments of end grips 104 that include a gripping portion 120 configured to be held in the hand of a user, and a grip sleeve portion 122 configured to accommodate insertion of bendable pole 102. Grip sleeve portion 122 may be removable from bendable pole 102, such as by threaded engagement. Alternatively, grip sleeve portion 122 may be fixedly attached to bendable pole 102. Bendable pole portion may also extend into end grips 104, and be secured thereto, either removeably or fixedly by other means that provide an attachment that is secure enough to withstand normal use of exercise device 100. As shown in FIGS. 24A, 24B, the surface of end grips 104 may be smooth or textured. FIG. 24A depicts an end grip 104 with ridges for gripping or hand orientation. FIG. 24B depicts an end grip 104 that has an embossed or over-mold component 128. This may be applied for decorative purposes or to impart tactile cues for hand positioning. End grip gripping portion 120 is shown in FIG. 24 as spherical, however, it may have other shapes suitable for different exercises, different users, or compatible with different features of exercise device 100. For example, if bendable pole is designed to exhibit different forces depending on which direction it is bent, end grip gripping portion 120 may be shaped to help a user determine how to orient exercise device 100 in their hands to obtain the force profile desired.

Images A-D in FIG. 25 show illustrative openings 182 in end grip sleeve portion 122. Image A shows a triangular opening 182 to accommodate a bendable pole 102 with a triangular cross-section. Image B shows a square opening 182 to accommodate a bendable pole 102 with a square cross-section. Image C shows a five-sided opening 182 to accommodate a bendable pole 102 with a five-sided cross-section. Image D shows a six-sided opening 182 to accommodate a bendable pole 102 with a six-sided cross-section. Opening 182 may have other shapes to coordinate with other cross-sectional profiles of bendable pole 102.

Bendable pole 102 may also have a trim fitting handle with a walking stick style wrist loop or shovel handle style at the ends.

Figure 29A:
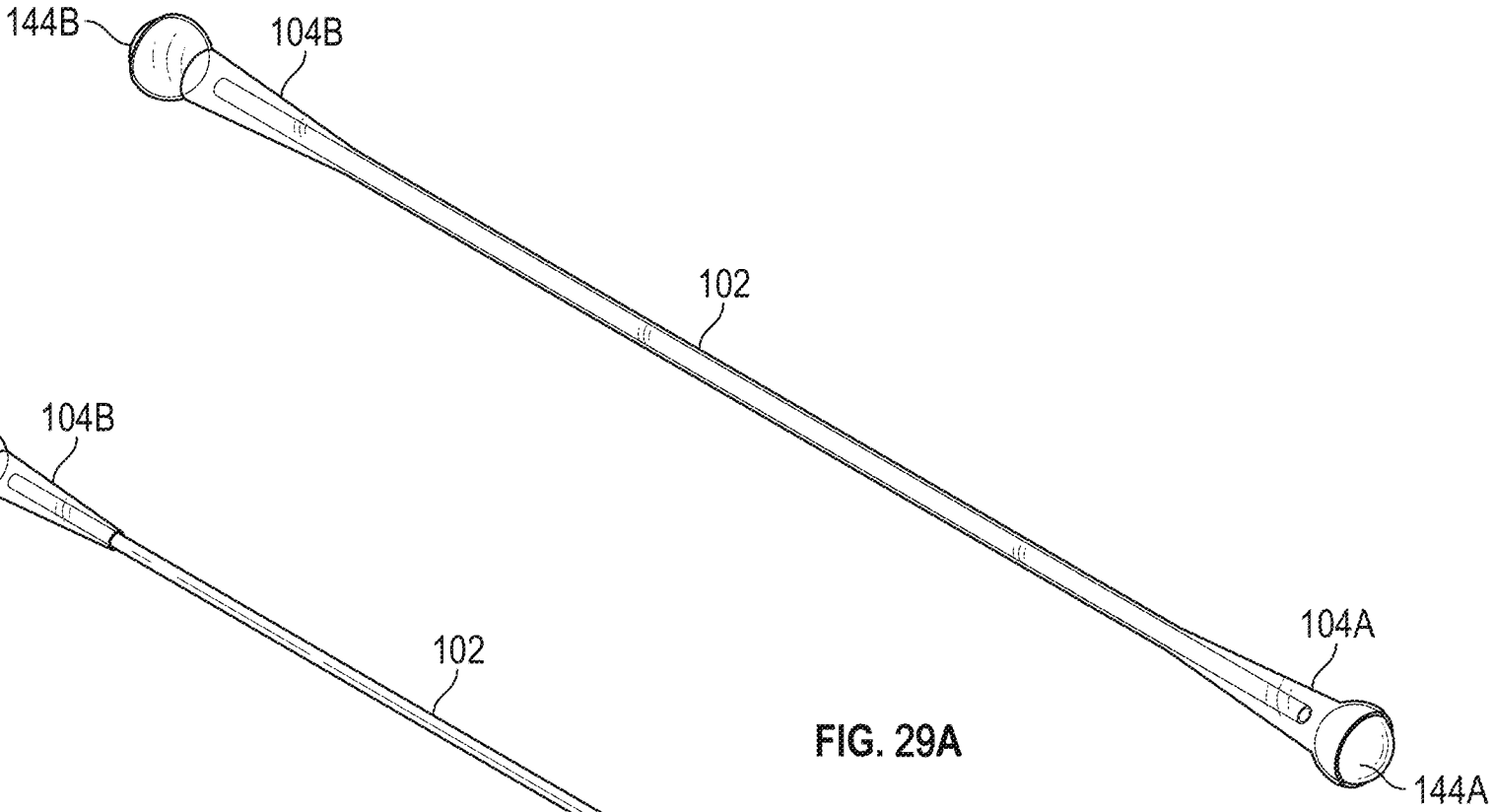
FIGS. 29A, 29B depict an exercise device having internally spherically shaped end grips to accommodate balls.
Figure 29B:
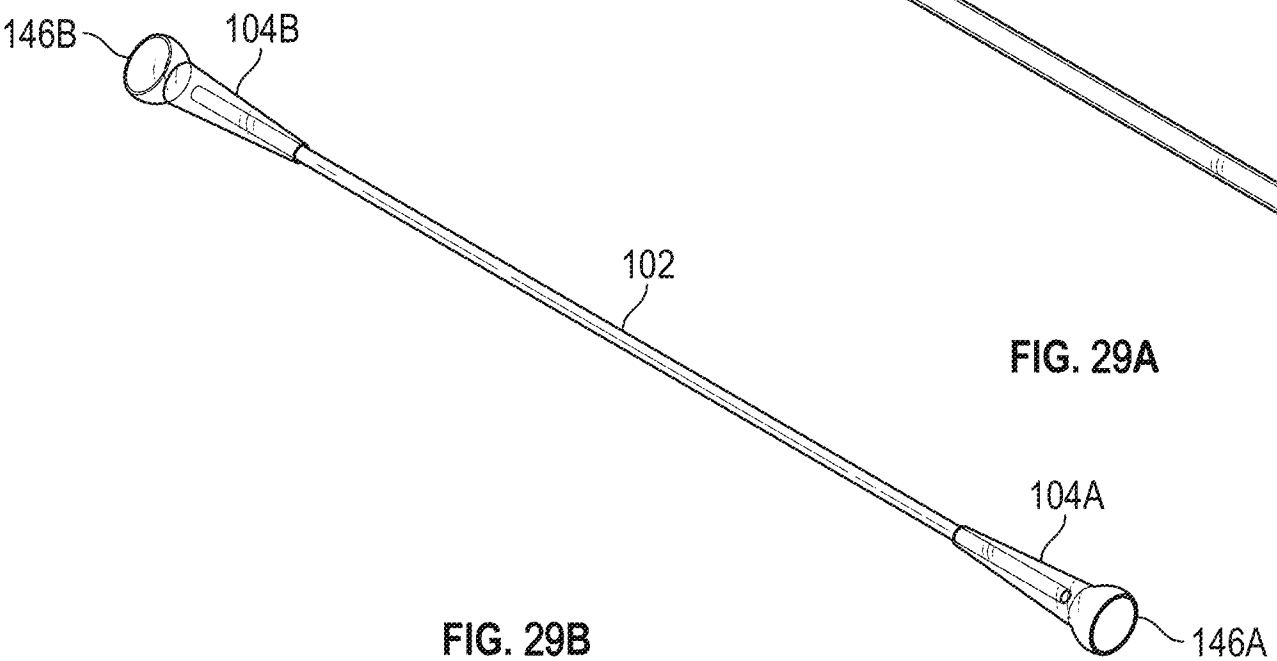

As shown in FIGS. 29A, 29B, exercise device 100 may include end grips 104A, 104B that are internally spherically shaped to accommodate balls 144A, 144B. Balls 144A, 144B may be replaceable and may include, for example, impact activated blinking lighted balls fit within the sockets 146A, 146B of end grips 104A, 104B. Balls 144A, 144B may be adhered to end grip sockets 146A, 146B with vinyl cement, rubber cement or silicone rubber cement, for example. Balls may also be permanently attached with other adhesives or attachment mechanisms, provided the connections are durable to withstand normal use of the exercise device. Illustrative diameters of balls 144A, 144B include 2.4 inches and smaller sizes down to 1.5 inches. Balls 144A, 144B may also be sponge rubber and non-lighted.

Bendable pole 102 may be hollow and clear, and may hold sparkle liquid and falling glitter as well as light collecting liquid that glows in the dark. Bendable pole 102 may also include internal glitter and glow, non-toxic liquids, which may also be contained in balls 144A, 144B.

In an illustrative embodiment, one or more of the middle grip 108 or end grip 104 end portions 126A, 126B are configured to house electronic components, such as lighting, batteries, control boards (PCBs), wire harnesses and/or audio and/or sensors. Sensors may, for example, provide one or more of: health-related data, information on movement and positions, calories burned, and other exercise-related information. The electronics disclosed throughout and other electronics may be incorporated into any component as noted, and could include any of the identified components, even if not mentioned herein with regard to a specific exercise device part.

Electronic components or assemblies ("electronic additions") may be strap on, clip on or integrated into middle grip 108 or nearby, or a combination thereof. The electronic components or assemblies may also be housed in the end grips. The electronic additions may have haptic feedback or lighting. The electronic additions may include batteries and controls. Portions of the electronic additions may be incorporated into or onto the exercise device, but may also exist apart from the exercise device and communicate either wirelessly or through hardwiring to electronic addition parts incorporated into or onto the exercise device. In an illustrative embodiment, electronic additions measure the amount of work and peak efforts, for example through strain sensors which produce a signal that is proportional to the amount of main bending arc deflection. Such components may require mechanical integration and activation of the components.

In an illustrative embodiment, to measure the amount of work and peak efforts of a user, a conductive plastic material, for example, those marketed under the names Velostat® or known as Linqstat, is integrated into first or second end grips 104A, 104B of bendable pole 102 where mechanical forces to the first or second end grips 104A, 104B or to ends of bendable pole 102 can be translated to a variable voltage and then to a bluetooth signal that is sent to a bluetooth sending unit. Or the signals may be transferred by hard wiring to a display and any other intermediary electronic components required to translate the signal into a displayed quantity or depiction, or to a storage medium. The conductive plastic material is pressure-sensitive so that squeezing it or squashing it reduces the electrical resistance. The electrical resistance reduction is converted to an electronic signal that represents the amount of work effort exerted by a user. In an illustrative embodiment, a carbon-impregnated, sheet plastic is used or a polymeric foil (polyolefins) impregnated with carbon black to make it electrically conductive. The conductive material produces a variable yet proportional resistance which may be converted to a proportional bluetooth signal and transmitted to an electronic device(s) for processing and displaying. For example, the signal may be transmitted to a user's smart phone on which a software application ("app") has been downloaded. The app converts the signal to the bending force equivalent by incorporating model type and size. Each pairing of user and sensor may be unique. This allows the app to programmatically calibrate the effort to the device in use and the associated smart app to track user work in many ways, including effort max, time per cycle, averages, total time, repetitions as well as additional functions for haptic feedback and acceleration sensing, each incorporated at the bluetooth sender. Signal changes and time between changes are integrated into the computation resulting in a factor that represents the amount of work accomplished, plus the amount of bar deflection and the amount of time between changes in displacement of the bar from straight or bent positions and back again. These factors once computed produce a measure of the work done.

Figure 7B:
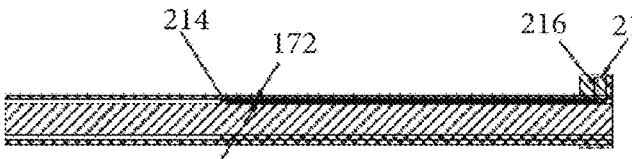
FIGS. 7A, 7B, 7C, 7D depict an illustrative embodiment of electronic additions and components thereof.
Figure 7C:
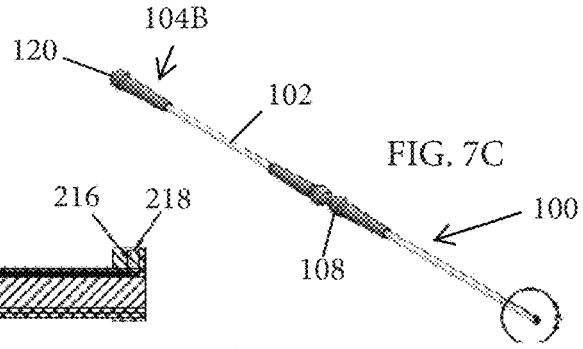
Figure 7A:
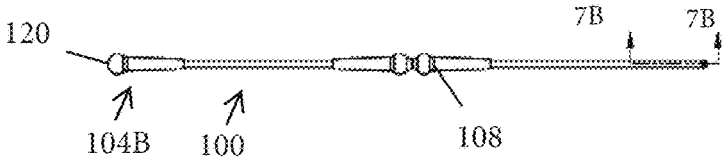
Figure 7D:
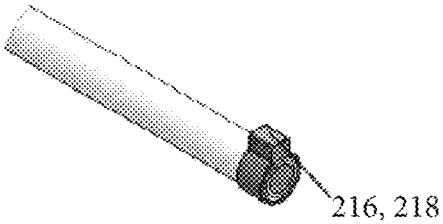

FIGS. 7A, 7B, 7C, 7D depict an illustrative embodiment of electronic additions and components thereof. FIG. 7A is an illustrative exercise device 100 without first end grip 104A. FIG. 7A depicts a section 7B-7B taken through a portion of bendable pole 102 on which first end grip 104A would be disposed. FIG. 7B is the cross-sectional view taken through 7B-7B. FIG. 7C identifies the portion of exercise device 100 that is enlarged in FIG. 7D.

FIG. 7B shows core 172 around which a pressure sensitive material 214 is disposed, either directly or with one or more intervening layers. Pressure sensitive material 214 may completely surround core 172, or may be strategically placed over one or more portions. By "strategically placed" it is meant located so that it can sense pressure to generate signals reflective of a user's effort or other activity or quantity that is being monitored. A signal converter 216 to convert signals generated by pressure on pressure sensitive material 214 is located at or near the end of bendable pole 102. Signal converter 216 is electrically connected to bluetooth, or other wireless transmitter 218. Signal converter 216 and transmitter 218 may be housed in an end grip 104, for example, within gripping portion 120. Middle grip portions and other bendable rod portions may also house electronic components.

Sensors are generally located on exercise device 100 in positions that facilitate sensing the pressure or other quantity to be measured. Other electronic components or assemblies are positioned in locations that do not interfere with use of the exercise device, and are located as necessary with respect to other components or assemblies that act in concert.

Figure 8A:
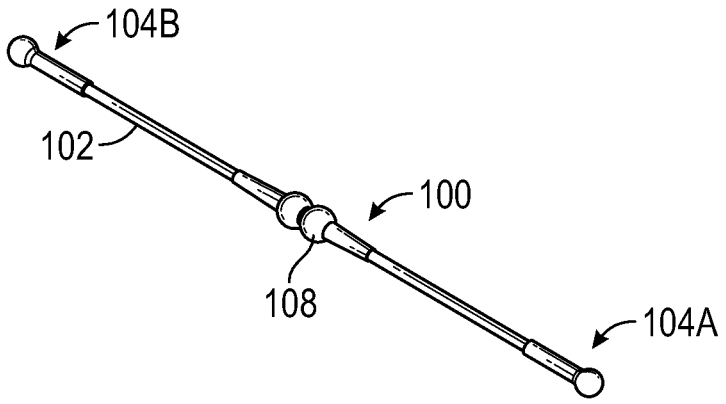
FIGS. 8A, 8B, 8C, 8D. depict an exercise device equipped with a massage assembly.
Figure 8B:
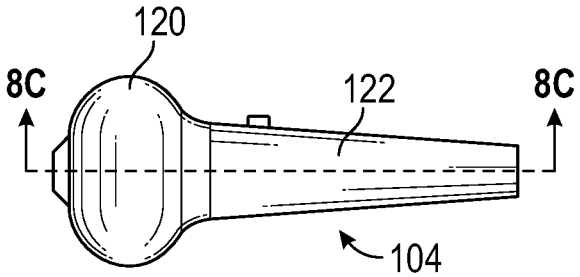
Figure 8C:
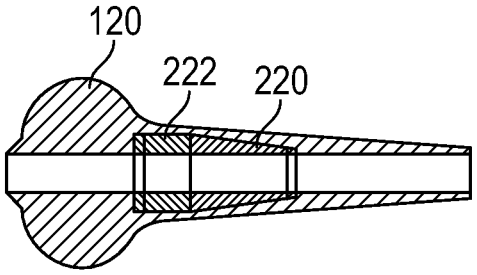

FIGS. 8A, 8B, 8C, 8D depict an exercise device 100 equipped with a massage assembly. FIG. 8A depicts exercise device 100 having end grips 104A, 104B. FIG. 8B depicts either of end grips 104A, 104B. It is noted that a massage assembly may be incorporated into either or both of end grips 104A, 104B. Additionally, or alternatively, middle grip 108 may house one or more massage assemblies. FIG. 8B shows cross-sectional line 8C-8C taken through end grip 104. Line 8C-8C extends through end grip sleeve 122 and end grip gripping portion 120. FIG. 8C depicts the cross-sectional view through line 8C-8C. An electric gear motor 222 having an eccentric lobe causes vibration concentrated in end grip gripping portion 120. A battery housing or pack 220 is also disposed within or on end grip 104. A battery, for example a rechargeable battery, contained in battery housing 220 powers motor 222. Any type of motor or combination of motor and other components that can generate a comfortable level of vibration and are compatible with exercise device 100 may be used.

Figure 8D:
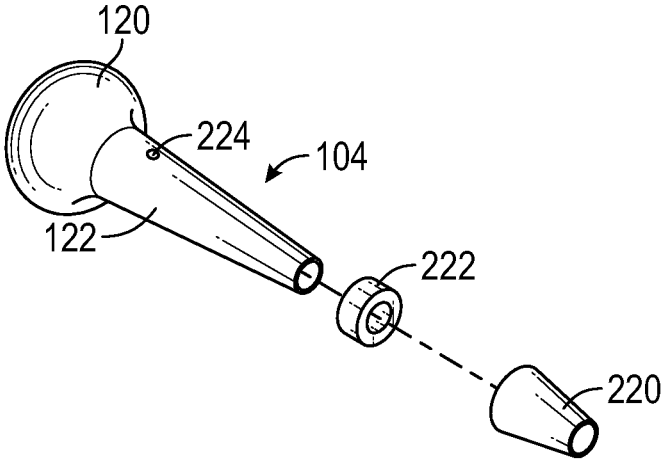

FIG. 8D is an exploded view of end grip 104. It shows end grip gripping portion 120 and grip sleeve portion 122, motor 222 and battery pack 220. A set screw 224 is shown on end grip 104 to secure end grip 104 to bendable pole 102.

Illustrative lengths of the exercise device with a motorized massage assembly include 36 inches and 24 inches, however, other lengths may be used. Additional components of exercise device 100 described above, for example comfort cover 156 and various rod and core configurations may be incorporated into the exercise device containing the motorized massage assembly.

It is further noted that sensor measurements may be obtained by sensors incorporated into wearable items such as gloves. Instead of the sensor portion of the measurement apparatus being incorporated into or attached to the exercise device, the sensors may be provided in a separate item that is configured so that through the pressure exerted by the user, and the amount of work and peak efforts of a user may be measured. In this embodiment, the complete electronic addition may be separate from the exercise device in whole or part.

Figure 9:
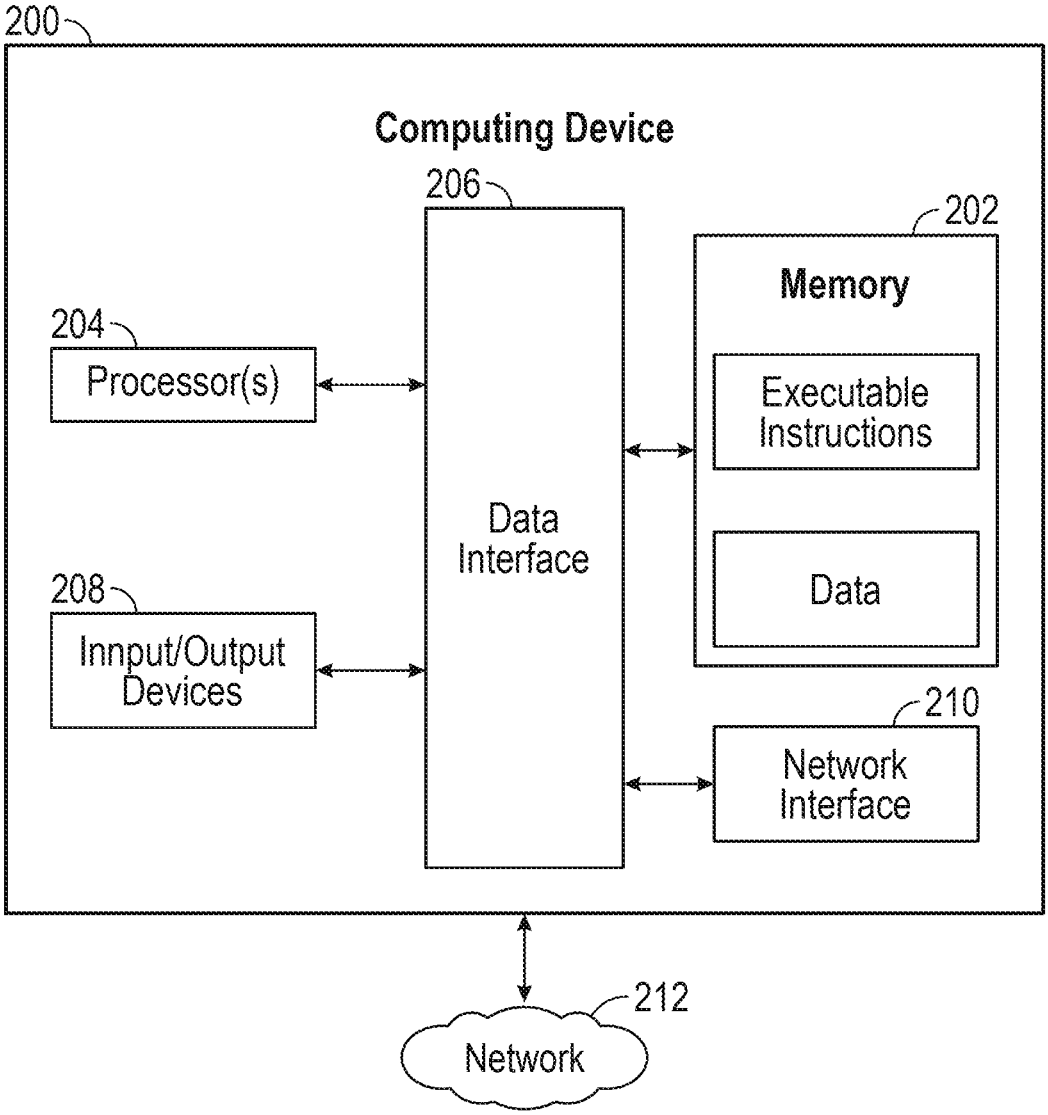

FIG. 9 is a block diagram of an illustrative embodiment of electronic components that may be incorporated into exercise device 100, or with which exercise device 100 may be configured to be used. A computing device 200, housed in whole or in part in exercise device 100, comprises a memory device 202 that may be a single memory device or multiple devices for storing executable code to implement any portion of exercise-related methods, algorithms, monitoring, audio, visual effects, or fitness app functionality, for example. Further contained in memory device 202 may be stored data, for example exercise-related data. Exercise-related data may include, for example, history of health statistics such as heart rate, blood pressure; exercise routine history; range of motion, and/or visual effect or audio repositories. One or more processors 204 are coupled to memory device 202 by a data interface 206. Processor 204 may be any device(s) configured to execute one or more applications and analyze and process data according to embodiments of the exercise device or methods. Processor 204 may be a single processor or a plurality of processors acting individually or in unison. Processor 204 may be, for example, a microprocessor, an application specific processor, or other device that may process and transform electronic data. Processor 204 executes the instructions stored on memory device 202. Memory device 202 may be integrated with processor 204 or be a separate devices. Illustrative types and features of memory device 202 include volatile and/or non-volatile memory. Various types of memory may be used, provided the type(s) are compatible with the system and its functions. Illustrative examples of memory types include, but are not limited to, various types of random access memory, static random access memory, read only memory, magnetic disk storage devices, optical storage media, and flash memory devices.

Input/output devices 208 are coupled to data interface 206. Input/output devices 208 may include, for example, sensors, image capture devices, data entry devices, displays, lights and speakers. A network interface 210 is also shown coupled to data interface 206, which may couple the computing device components to a private or public network 212.

One or more electronic components may be connected wirelessly to one another. One or more of the electronic components may be contained in or on various parts of exercise device 100, for example in bendable pole 102, end grips 104, or middle grip 110. FIGS. 8A, 8B, 8C, 8D show an illustrative example of electronic components in an end grip. Electronic components may also be affixed in other manners to exercise device 100. The computer system diagrammed in FIG. 9 may include a downloadable fitness app, or other apps to provide the functionality and user interface for implementing the desired methods, monitoring or other exercise-related functionality.

Figure 10A:
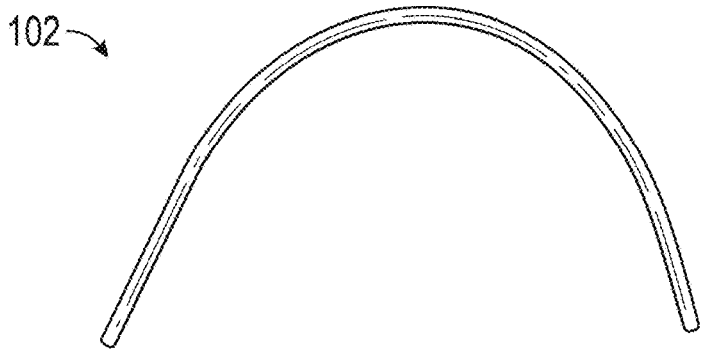
FIGS. 10A-C are schematics of the bendable pole portion of the exercise device bent to different degrees.
Figure 10B:
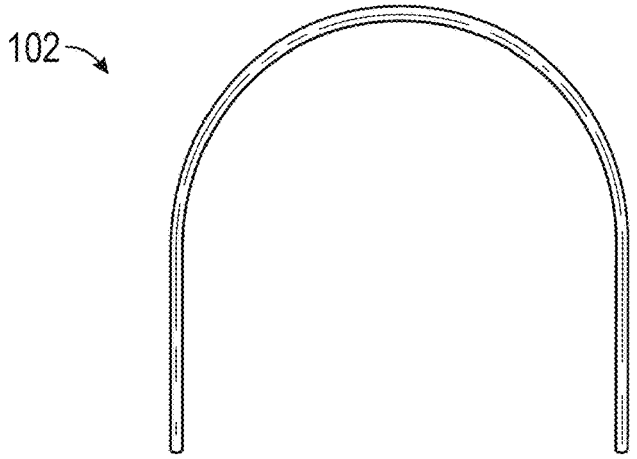
Figure 10C:
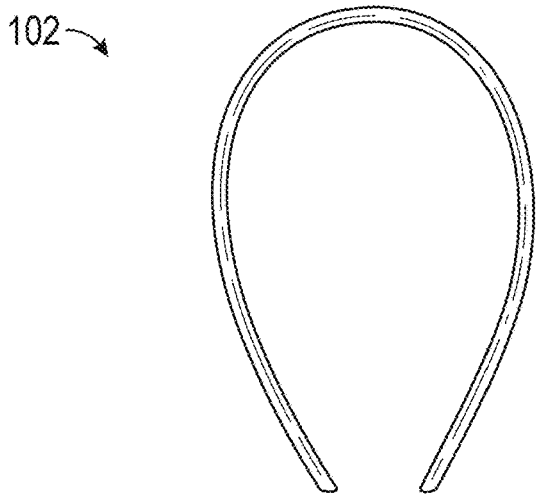

FIGS. 10A-C are schematics of a bendable pole 102 bent to different degrees. FIG. 10A shows an illustrative bendable pole 102, 60 inches long, bent so that its ends are 36 inches apart. In an illustrative embodiment, bendable pole 102 is formed of 5/16 inch diameter FRP fiberglass reinforced plastic rod and produces approximately 8 pounds tension between the ends of bendable pole 102.

FIG. 10B shows an illustrative bendable pole 102, 60 inches long, bent so that its ends are 24 inches apart. In an illustrative embodiment, bendable pole 102 is formed of 5/16 inch diameter FRP fiberglass reinforced plastic rod and produces approximately 10 pounds tension between the ends of bendable pole 102.

FIG. 10C shows an illustrative bendable pole 102, 60 inches long, bent so that its ends are 3 inches apart. In an illustrative embodiment, bendable pole 102 is formed of 5/16 inch diameter FRP fiberglass reinforced plastic rod and produces approximately 11 lbs tension between the ends of bendable pole 102.

The force between the bendable pole ends is cumulative according to the number of rods 112 included in bendable pole 112. For example, a three rod bendable pole 102 may produce about 30 lbs of tension force when the bendable pole ends are 24 inches apart. A four rod bendable pole 102 may produce about 40 lbs of tension force when the bendable pole ends are 24 inches apart. A five rod bendable pole 102 may produce about 50 lbs of tension force when the bendable pole ends are 24 inches apart. A six rod bendable pole 102 may produce about 60 lbs of tension force when the bendable pole ends are 24 inches apart. A seven rod bendable pole 102 may produce about 70 lbs of tension force when the bendable pole ends are 24 inches apart. An eight rod bendable pole 102 may produce about 80 lbs of tension force when the bendable pole ends are 24 inches apart. Higher forces can be attained by adding metal spring rods to hollow core areas at a bend and adding larger diameter FRP rods.

Larger than 5/16 inch diameter rods 112 require special FRP formulation to increase flexibility without fracture of a rod 112 bent at 3 inches point to point. Larger rods 112 can achieve the flexural durability necessary to get to the 3 inches point to point performance standard at a lower proportional total effort as compared to standard FRP at 5/16 inch.

Figure 11A:
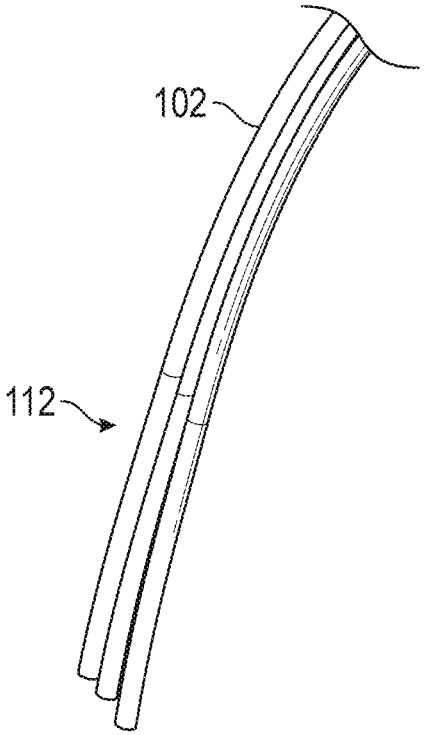
FIGS. 11A-B depict how rods are displaced along their length with respect to one another when the bendable pole, and hence rods are flexed.
Figure 11B:
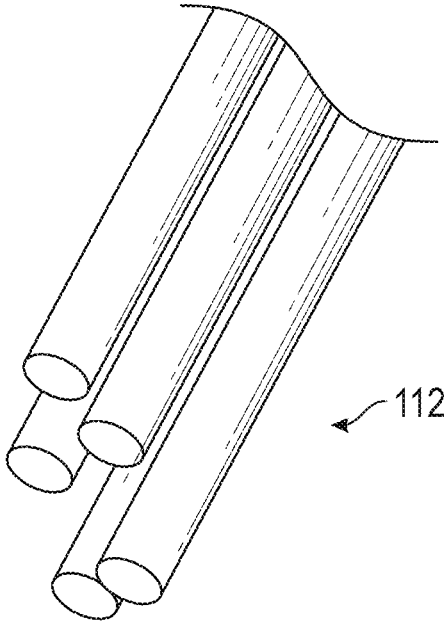

FIGS. 11A-B depict how rods 112 are displaced along their length with respect to one another when bendable pole 102, and hence rods 112 are flexed. Rods 112 slide with respect to one another so that bendable pole ends that may have aligned with one another when bendable pole 102 was straight, now have end positions that vary with respect to one another. This is shown in FIG. 11A and highlighted in FIG. 11B by showing the enlargement of the ends of rods 112. If rods 112 are disposed within or around a spacer 110 or other intermediary component, rods 112 will slide against or with respect to spacer 110. If rods 112 are not spaced apart by a spacer, or otherwise abut one another, they will slide against each other. The degree of possible sliding, at a minimum, allows bendable pole 102 to flex to the degree desired, without negatively affecting the integrity of exercise device 100, and in particular the connection between bendable pole 102 and end grip 104 or middle grip 108. This connection may be, for example, between bendable pole 102 and grip sleeve 122, or if no grip sleeve is present, between bendable pole 102 and gripping portion 120. Rods 112 may maintain engagement with first end grips 104 and middle grip 108, either directly or indirectly through intervening components or materials, when bendable pole 102 is flexed into an arc shape.

Illustrative core diameters includes 1 5/16 inch, 2 3/8 inch, 3 7/16 inch and 4 1/2 inch. In an exemplary embodiment, core diameter and suitable FRP formulation are selected so the combination achieves a 60"×3" point to point non-destructive, anti-splintering standard and non-fatigue elasticity to withstand normal use.

Full or partial polyurethane or neoprene grip foam slide on coverings in all may be disposed around bendable pole 102.

Overall bar lengths of exercise devices 100 may be for example, in the range of 24 inches to 72 inches. Lengths of 48 inches to 72 inches will be more suitable to adults, or stronger, taller users. Lengths in the range of 24 inches to 48 inches with lower force ranges and higher elasticity and safety features will generally be more suitable for children.

Exercise device 100 may be configured so bending is directional. This may be a result of, or accomplished by, the distribution of rods 112 within or around a spacer, rod cross-sectional shape or other factors. Exercise device 100 may also be configured to bend uniformly in any direction.

Figure 12:
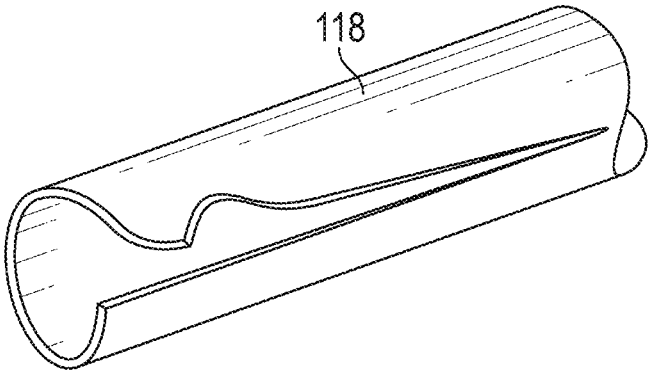
FIG. 12 depicts a sleeve that may enclose components of the exercise device.

Bendable pole 102 may include a shrink-on flexible plastic layers, that may be used, for example, for branding or other labeling. FIG. 12 depicts a sleeve 118, which may encase the one or more rods 112. One or more spacers 110, or other components disposed along bendable pole 102, may also be enclosed within sleeve 118. Sleeve 118 may be comprised of a thermo-shrink and/or braided mesh material, and/or other mesh material. Incorporating a sleeve into bendable pole 102 may provide a surface on which text or designs may be adhered or printed. This may include, for example, branding, advertising, instructions for use of the exercise device, warnings, or any other informational, decorative or identifying material. Illustrative materials for sleeve 118 include three types: (1) clear PVC heat shrink process applied flexible tubing; (2) over-molded polyurethane of 40 to 80 durometer, including, for example, those in solid colors or clear applied in casting via injection molding; and (3) polyurethane or neoprene closed cell comfort foam covering, for example 1/8" thick.

The PVC heat shrink flexible tubing can cover a decorative layer where preprinted custom art and logos may be applied and protected from abrasion and wear by the final outer PVC heat shrink layer. A safety layer of polyethylene terephthalate (PET) braided mesh, which may also be decorative, can cover and help contain the main bending rods 112 and protects against fracturing and splintering projections of FRP in the event of bar destruction by accident or misuse. The combination of the braided PET mesh cover and the clear heat shrink layer may support all exercise device force components and may contain them in the event of catastrophic breakage keeping all FRP contained. These features may also be achieved by use of the injection molded polyurethane.

In a illustrative example, first end grip 104A and second end grip 104B may comprise one or more of the following materials: textured polyurethane and integral skin molded foam. First end grip 104A and second end grip 104B may be identical to one another, as shown in FIG. 1, or may have different configurations.

First end grip 104A and second end grip 104B may be bonded to bendable pole 102 or may be removeably attached thereto. For example, first end grip 104A and second end grip 104B may be formed of a flexible, securely fitting polyurethane that stays on bendable pole 102 through a combination of mechanical interference over a small circumferential bump at the end of the bar and through adhesion between the polyurethane of the end grip 104A, 104B and the PVC heat shrink or injected molded polyurethane.

First end grip 104A and/or second end grip 104B may have a hollow interior section configured to accommodate electronic components such as sensors, light or audio components, for example. First end grip 104A and second end grip 104B may also include weights, for example within the hollow interior section. Weights may be incorporated into first end grip 104A and second end grip 104B as a permanent component, or may be removeable. A plurality of weights may be provided with exercise device 100 and selectively added or removed from exercise device 100, particularly if first end grip 104A and second end grip 104B are removeable. First end grip 104A and second end grip 104B themselves may serve as interchangeable weights. Cushioned end grips with a soft outer surface can allow weighted ends without diminishing safety characteristics.

In an illustrative embodiment, weights are attached to exercise device 100 and may be weighted foam segment covers that are stretch fabric covers that have flexible heavy metal rubber composite materials that wrap around pole 102 adding up to a few pounds per side of exercise device 100. The added weight in motion can have substantial dynamic effects during exercise programs; similar to wearing weights on your ankles in step aerobics but do not add to the bending arc forces. Additionally, hollow core models have the option of adding additional metal spring rods to the hollow central core of certain models with a large hollow core, for example up to 12 each, ⅛ inch diameter steel rods to about 3 lbs overall and considerable bending arc force.

Exercise device 100 may be configured to provide particular spring forces, such as by the materials used, length of bendable bar 102, diameter or cross-sectional size and shape of bendable bar 102 and spacer type and configuration. In an illustrative embodiment, the length of exercise device 100 is in the range of about 3.0 feet to 6.5 feet. In an illustrative embodiment, the diameter of bendable pole 102 is in the range of about 3/16 inch to about 5/16 inch. In an illustrative embodiment, force/bending moment about center point/spring rate/resistance may have a range from approximately 3 to 10 lbs. of force per rod element at 60 inches length and 24 inches end to end deflection.

Rod efforts operate collectively and vary by rod diameter and length. For example, a bar with 6 force rods having 60 inches overall length and having a 5/16 inch diameter per rod in one bar collection will produce approximately 60 lbs. of force when ball ends are deflected to within 24 inches of each other in a U shape. One 60" long 5/16 inch rod may produce about 10 lbs. of force when fully deflected. Other diameter rods and lengths will produce proportionately more and less force at the 24 inches deflection and 60 inches length base line.

Figure 13A:
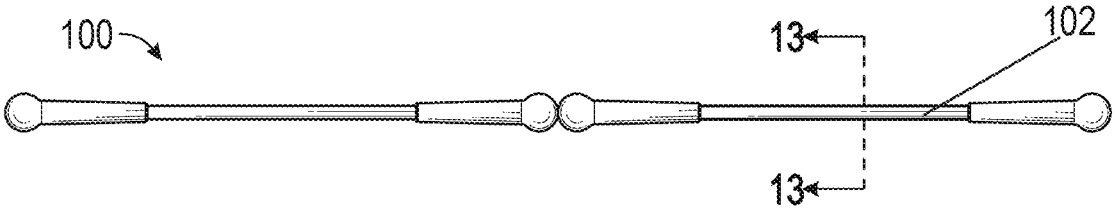
FIGS. 13A,B depict an illustrative embodiment of an exercise device in which the bendable pole has a single rod core.
Figure 13B:
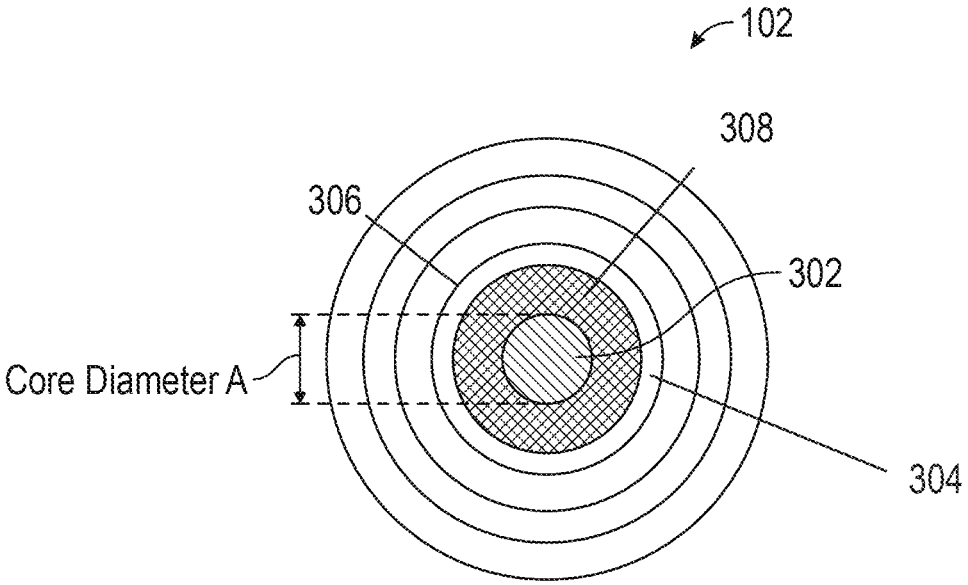

FIGS. 13A,B depict an illustrative embodiment of exercise device 100 in which bendable pole 102 has a single rod core 302. FIG. 13A shows an illustrative exercise device 100 that may include the single rod core 302 and FIG. 13B show a cross-sectional view taken at line 13-13. Bendable pole 102 includes a tubing 304 comprising PVC or other thermoplastic polymer. Tubing 302 has a spiral wire reinforcement layer 308 as a safety containment protecting the user from injury in the event of fracture of FRP through misuse or accident. A foam outer layer 306 is disposed around tubing 304. Foam outer layer 306 may comprise, for example, a closed cell foam of medium density polyurethane or neoprene and may have a 3⅛ inch wall thickness. The embodiment shown in FIG. 13A, like other embodiments described herein, may have removable/replaceable end grips 104A, 104B, removable/replaceable middle grip 108 and an adjustable middle grip 108.

FIGS. 14A, 14B, 14C, 14D depict further illustrative embodiments having X core 148 with a strain relief center hole 152 to reduce internal stress under larger bending angles and help prevent fiberglass fracturing. FIGS. 14A, 14B, 14C, 14D show how X core 148 deforms upon bending of bendable pole 102. X core 148 and adjacent components are within bendable pole 102. FIGS. 14A, 14B, 14C, 14D are cross-sections of a pole of the exercise device.

Figure 14A:
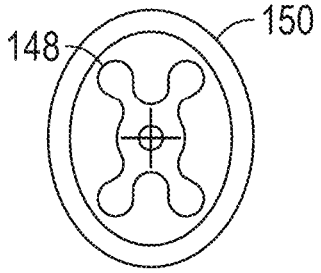
FIGS. 14A, 14B, 14C, 14D depict illustrative embodiments of a bendable pole having an x shaped inner core with a strain relief center hole surrounded by a tubing having an elliptical cross-section.
Figure 14B:
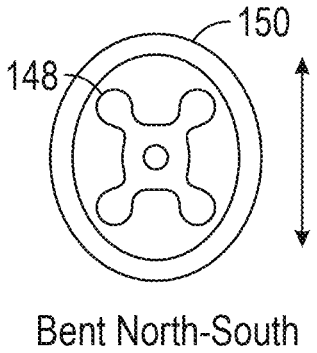
Figure 14C:
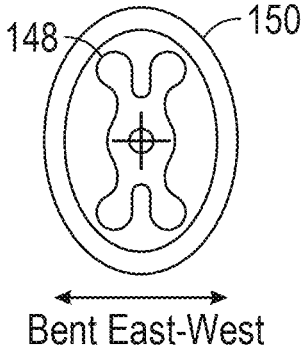

FIG. 14A shows a cross-section of X core 148 in a tubing 150 when bendable pole 102 is unbent. Tubing 150 in this illustrative embodiment has an elliptical cross-section. When bendable pole 102 is in the unbent position, X core 148 is elongated in the "north-south" direction as shown by the arrow in FIG. 14B. Tubing 150 deforms as X core 148 deforms. The terms "north-south" and "east-west" as used herein are merely to identify relative directions and do not have any other relevance to position or direction. FIG. 14B depicts X core 148 when bendable pole 102 is bent in a first direction, designated as "north-south" and shown by the arrow in FIG. 14B. When bent in the north-south direction, the X core 148 is less elongated than when in the unbent position. FIG. 14C depicts bendable pole 102 bent in the east-west direction as shown by the arrow in FIG. 14C. When bent in the east-west direction, the X core 148 is more elongated than when in the unbent position or when bent in the north-south direction.

X core 148 may be comprised of an FRP pultruded material, for example, or other fiber-reinforced plastic. In an illustrative embodiment, X core 148 has a strain relief center hole 152 that is ⅛ inch in diameter strain through the length of the core. A bendable pole 102 with the X core 148 may be, for example, polyurethane over-molded or a co-extruded X covered bendable pole.

The minor and major diameters of X core 148 may be bent at any 360 degree rotational position of bendable pole 102. Bendable pole 102 performance favors bending along the east-west direction (FIG. 14C) as the larger surface naturally lays more easily across ones shoulders. This east-west bend produces a lighter effort as the X shape flattens and has a shorter cross-section bending against the minor profile. Conversely, when bendable pole 102 is bent against the major profile north-south direction, a larger vertical profile resists bending to a greater degree.

The X shape of inner core 148 can be defined by the distance between the top and bottom head pairs (L1) and the left and right side pairs (L2), as will be described further below. When L1 and L2 are equal, the main bending arc produces equal and symmetrical forces. When L1 and L2 are different lengths, the main bending arc forces become asymmetrical providing a range of greater or lesser effort in the bending arc depending upon end grip rotation relative to the user's grip.

Figure 14D:
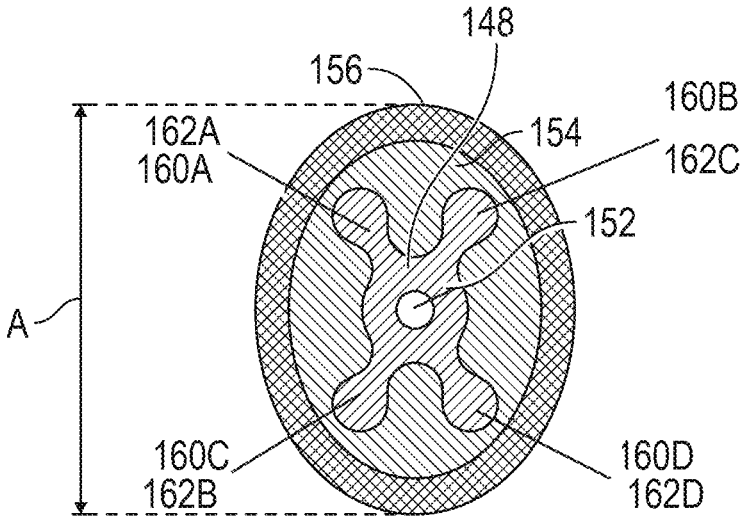

FIG. 14D depicts additional detail of a cross-section of bendable pole 102 having the X core 148. In an illustrative example, an outer X core covering 154 may be formed by a co-extrusion or casting process over X core 148. In an illustrative embodiment X core covering 154 is constructed of polyurethane and has a firmness density from 30 to 80 shore A durometer. Outer X core covering 154 may be opaque or transparent.

A comfort cover 156, for example, a closed cell medium density foam, may be disposed around X core covering 154. An illustrative material is polyurethane. Comfort cover 156 may be in the form of a tube, for example with an approximate 0.1 inch wall thickness, that surrounds X core 148. Comfort cover 156 may span the entire length of bendable pole 102 or a portion of its length. Exercise device 100 may also be constructed without a comfort cover 156.

The minor and major diameters of bendable pole 102 when bendable pole is in an extended position, not including the comfort cover 156, are shown in FIG. 14D by dimensions B and A, respectively. The X shape of X core 148 is defined by the distance between the top head pairs 160A, 160B and the bottom head pairs 160C and 160D, and the distance between the left side pairs 162A, 162B and the right side pairs 162C, 162D. With equal lengths the main bending arc produces substantially equal and symmetrical forces. When the pair lengths are different the main bending arc forces become asymmetrical providing a range of greater or lesser effort in the bending arc depending upon the gauge of the bendable pole 102 and the gripping portion 120 end rotation relative to the users grip. Illustrative gauges in inches include:

| Size | A | B | C |
|---|---|---|---|
| Light | .80 | .60 | .312 |
| Medium | 1.00 | .75 | .312 |
| Strong | 1.20 | .90 | .375 |
| Heavy Duty | 1.40 | 1.05 | .375 |

The combination of gauge size of bendable pole 102, X core 148 gauge and the hardness of the co-extruded polyurethane or other integral covering of a range of durometer, produces a wide range of bar efforts from light to heavy duty. The gauge size and effort ranges and bendable pole 102 overall lengths in 0.5 inch increments can cover a very wide range of population with a comfortable fit and exercise suitability.

Figure 15A:
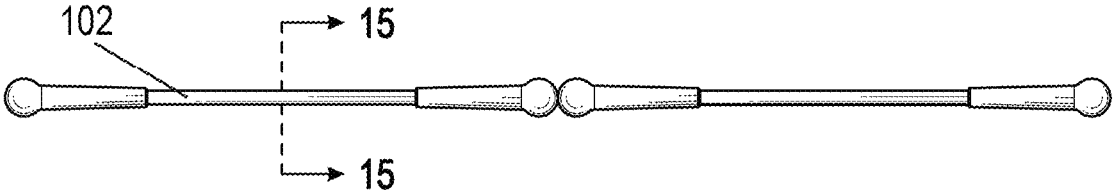
FIGS. 15A, 15B, 15C, 15D show cross-sections of bendable poles.
Figure 15B:
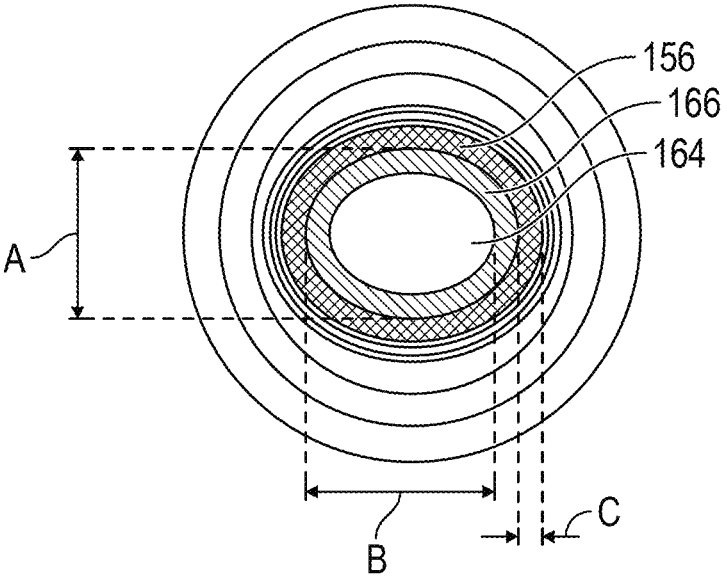
Figure 15C:
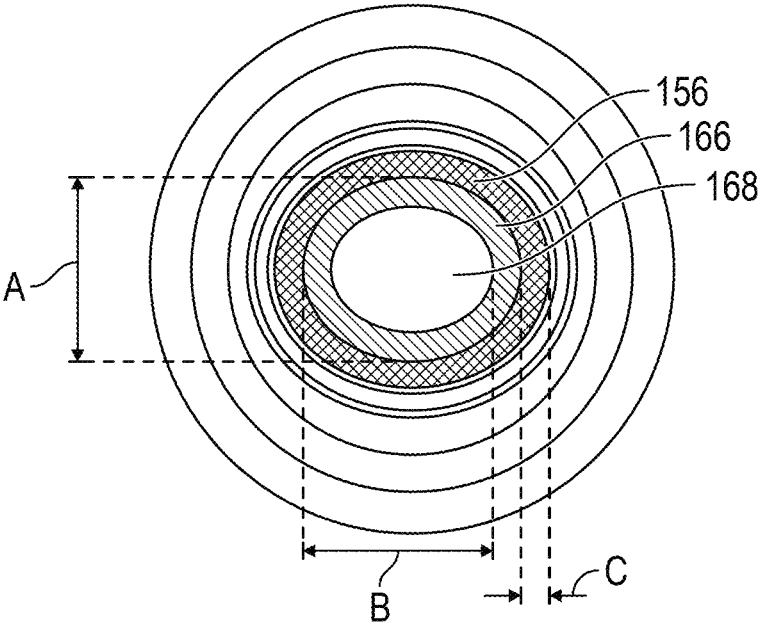
Figure 15D:
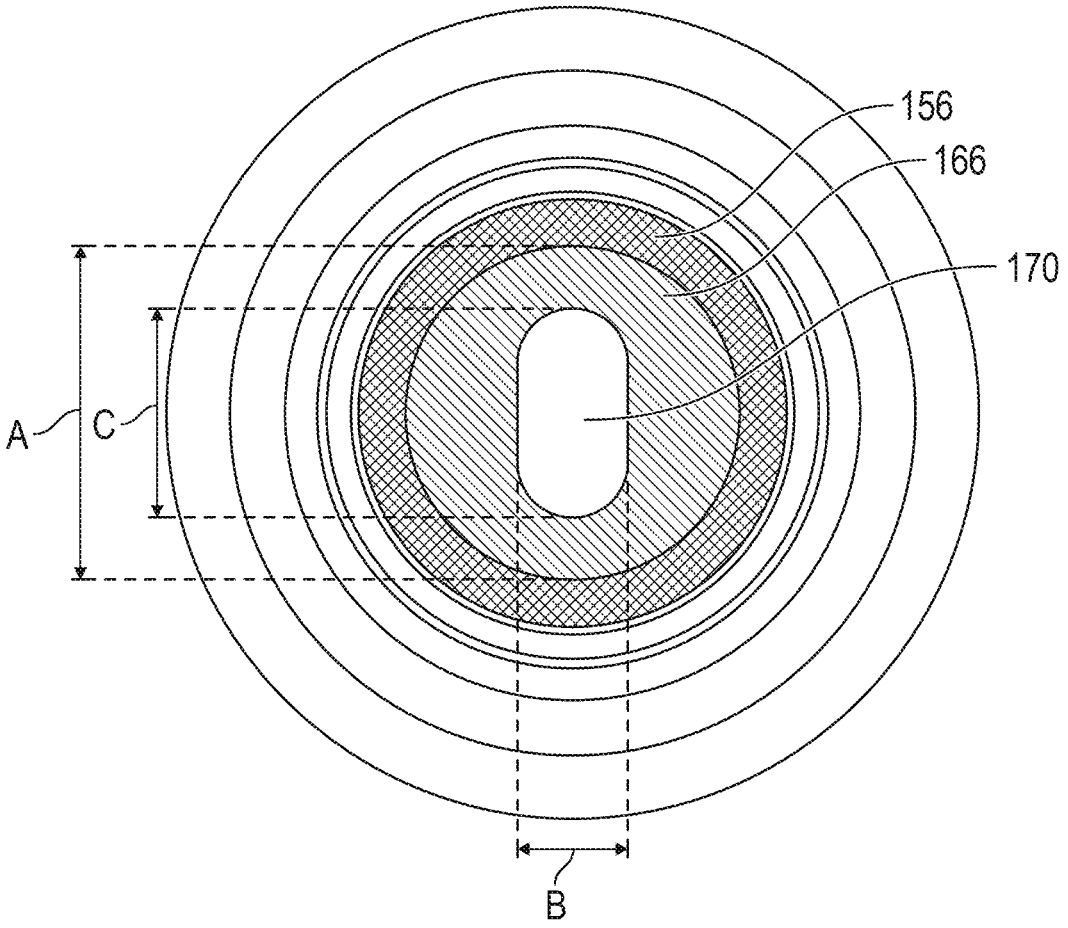

FIG. 15A shows an illustrative exercise device 100 with a cross-section indicated though 15-15 of bendable pole 102. FIGS. 15B, 15C, 15D show different embodiments of cross-section 15-15. FIG. 15B shows cross-section 15-15 of bendable pole 102 with a hollow core 164. A flex-shell 166 surrounds hollow core 164. A comfort cover 156 is disposed around flex-shell 166.

The shape of flex-shell 166 is defined by dimensions A and B. When equal, flex-shell 166 is round and the main bending arc produces substantially equal and symmetrical forces.

Similar to the illustrative embodiment shown in FIGS. 14A-D, when dimensions A and B are different lengths, the main bending arc forces become asymmetrical providing a range of greater or lesser effort in the bending arc, depending upon gripping portions 120 and rotation relative to the user's grip. The ratio of L1 to L2, regulates greater or lesser asymmetrical main bending arc forces as does the profile overall size and wall thickness.

Hollow core 164 allows for deformation of the elliptical profile of flex-shell 166 during a bending cycle. This enables full bending range of motion of bendable pole 102 from first end grip 104A to second end grip 104B. The relatively large, elliptical, hollow core 164 profile causes the bending arc force to be less when bending across its cross-sectional long length. While bending parallel to the long length produces a greater bending arc force. Hollow core 164 may be filled with a spring, such as a small diameter (approximately ⅛ inch, for example) steel spring, to provide a further performance feature. In addition, or instead, hollow core 164 may house rods 112 to add weight and increase bending arc forces without building high internal stresses that would result in rod fracture. As noted elsewhere, rods 112 may comprise FPR, for example.

The combination of technical features; flex-shell 166, metal spring fillers and generous deformation tolerance may assure that long term fatigue free performance is delivered.

The "zero" or oval shape, such as shown in FIG. 15B, provides as much as 50% difference in main bending arc force by simply rotating bendable pole 102 within the user's normal grip. It is not necessary to reset or adjust any feature of the exercise device 100 to access a wide range of bending force differential.

Examples of dimensions of bendable pole 102 with elliptical zero-shaped hollow core 164 include:

| Size | A | B | C |
|---|---|---|---|
| 1 | .88" | 1.12" | 1.25" |
| 2 | .76" | .98" | 1.25" |
| 3 | .65" | .86" | 1.25" |
| 4 | .52" | .74" | 1.25" |

FIG. 15C depicts a cross-section of a further embodiment of bendable pole 102. Hollow core 168 has a less pronounced oval shape, referred to an "Easter egg" shape as opposed to the "zero" shape of hollow core 164. Accordingly, the effort differential will be less with the Easter egg hollow core 168 than with the zero hollow core 164. With the less extreme and more rounded egg shape there is a smaller effort differential of approximately 25%.

Examples of dimensions of bendable pole 102 with elliptical, Easter egg shaped, hollow core 168 include:

| Size | A | B | C |
|---|---|---|---|
| 1 | 1.0" | .85" | .125" |
| 2 | .87" | .70" | .125" |
| 3 | .75" | .60" | .125" |
| 4 | .62" | .40" | .125" |

FIG. 15D depicts a cross section of bendable pole 102 showing an elongated hollow core 170 with a round outer flex-shell 166. This configuration will provide a more symmetrical surface feel to a user as compared to the configurations shown in FIGS. 15B and 15C. However, by adjusting the shape of elongated hollow core 170, asymmetry is introduced into the bending effort depending upon the orientation of the user's grip on first and second end grips 104A, 104B.

Elongated hollow core 170 is defined by a width B and a length C. Flex-shell 166 has a diameter A. The greater the difference between width B and length C, the greater the effort differential. The effort differential applies to all hollow core and flex-shell methods by introducing asymmetry in the main bending arc effort. Asymmetry though may not always be a desirable feature for a user. This is different than round profiles with symmetrically proportioned and concentrically located internal features, which produce unilateral performance regardless of the position of bendable pole 102 or the user's grip.

Examples of dimensions of bendable pole 102 with round hollow core 170 include:

| Size | A | B | C |
|---|---|---|---|
| 1 | .62" | .25" | .43" |
| 2 | .75" | .28" | .50" |
| 3 | .87" | .30" | .55" |
| 4 | 1.0" | .32" | .62" |

Figure 16A:
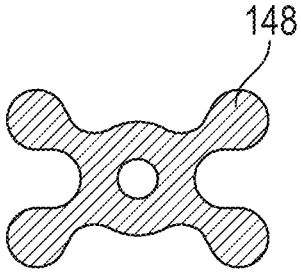
Figure 16B:
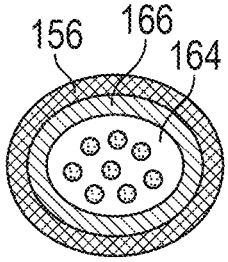
Figure 16C:
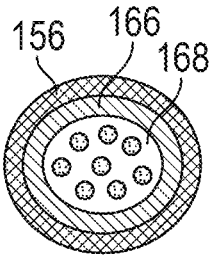
Figure 16D:
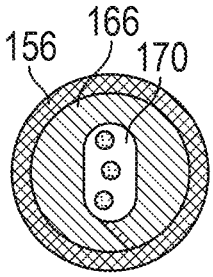

FIG. 16A1 depicts an illustrative embodiment of a flex-shell 166 with rods 112 within a core 172. Core 172 may be in one of the forms shown in FIGS. 16A, 16B, 16C, 16D, which include, X core 148, zero-shaped hollow core 164, Easter egg-shaped hollow core 168, and elongated hollow core 170, respectively, or any core shape. Reference number 172 will be used herein as a generic core and encompasses cores of other shapes. Rods 112 can add weight and additional bending effort to hollow core and hollow bendable pole embodiments. In an illustrative example, zero-shaped hollow cores 164 and Easter egg-shaped hollow cores 168 may be filled with small diameter (for example ⅛ inch) rods 112, which may be made of, for example, spring steel and/or FRP. Hollow bendable poles 102 may accommodate smaller diameter rods 112 of that construction.

X core 148 can be added inside the Easter egg-shaped core 168 or zero-shaped core 164. X core 148 can accentuate the effort differential experienced by a user when simply rotating bendable pole 102 by 90 degrees, for example, within the user's grip on the grip ends 104A, 104B. No adjustment of the device is needed as there are no switches or levers or dials to engage or manipulate: only the change in position of bendable pole 102 is within the users grip.

The addition of rods 112 increases effort without increasing internal stress upon bendable bar 102 or flex-shell 166, thus preventing buildup of internal stresses that could lead to fracture of the material, such as FRP in extreme bending use. Although the added weight may be from one to a few pounds, the added weight is moving dynamically during exercise forms and actions and a little extra weight can have a substantial effect on overall feel and user experience.

Figure 17A:
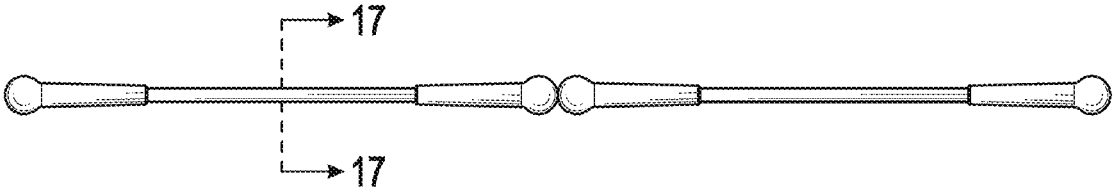
FIGS. 17A, 17B, 17C, 17D, 17E depict cross-sectional views of a bendable pole, each showing different multi-sided profiles, and one elongated oval shape.
Figure 17B:
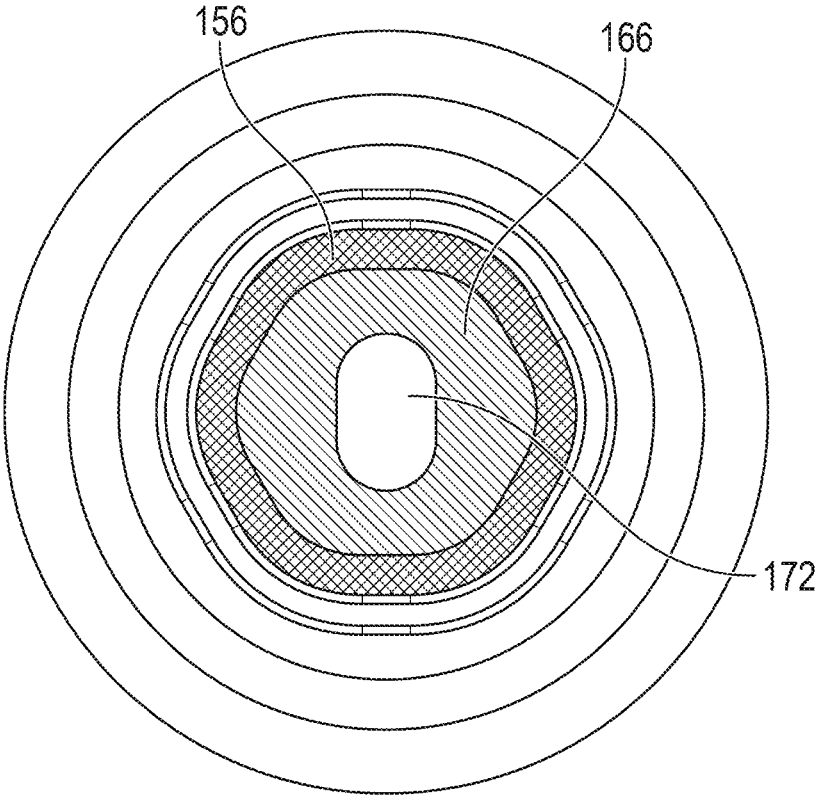

FIG. 17A depicts an exercise device 100 through which a cross-sectional line is shown as 17-17 taken through bendable pole 102. FIGS. 17B, 17C, 17D, 17E depict different embodiments of cross-sections through line 17-17. Each cross-section through line 17-17 shows different multi-sided profiles instead of round. FIG. 17B depicts a bendable bar 102 with a six-sided flex-shell 166. Six-sided flex-shell 166 has a comfort cover 156 that takes on the shape of the six-sided flex-shell 166.

Figure 17C:
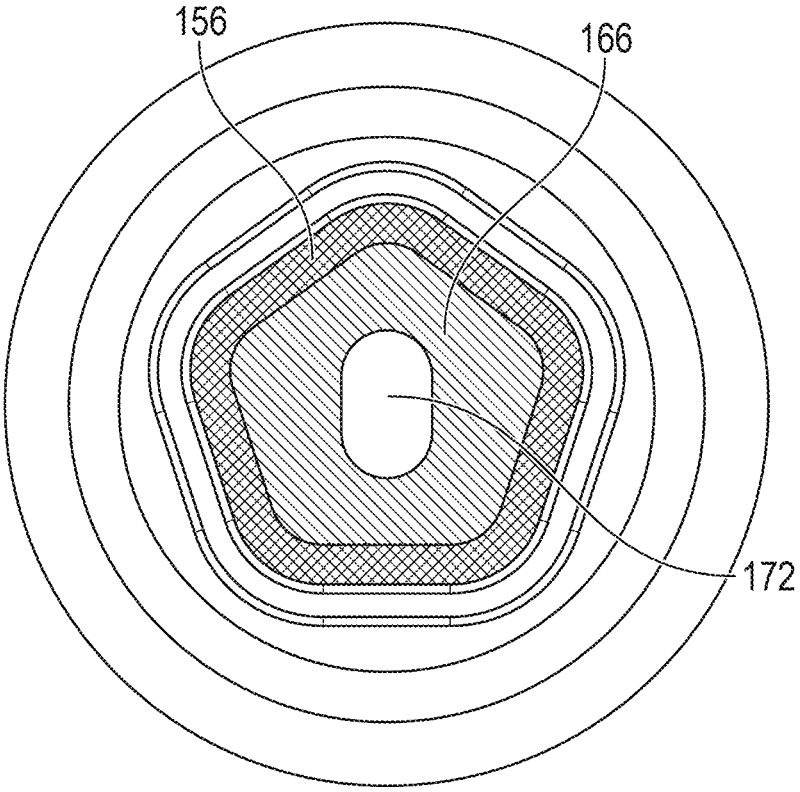

FIG. 17C depicts a bendable bar 102 with a five-sided flex-shell 166. Five-sided flex-shell 166 has a comfort cover 156 that takes on the shape of the five-sided flex-shell 166.

Figure 17D:
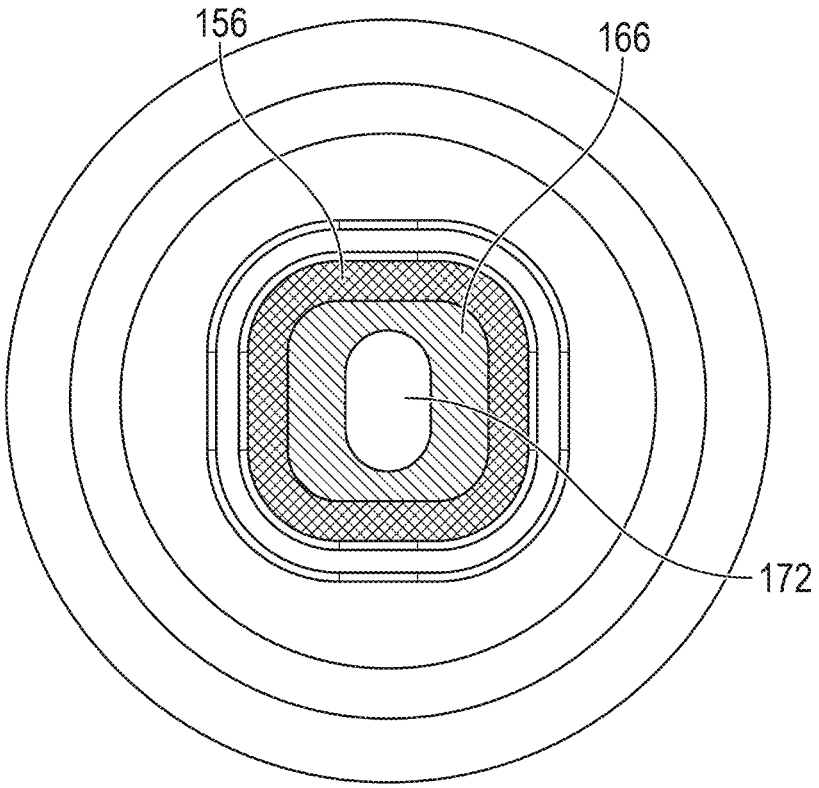

FIG. 17D depicts a a bendable bar 102 with a four-sided flex-shell 166. Four-sided flex-shell 166 has a comfort cover 156 that takes on the shape of the four-sided flex-shell 166.

Figure 17E:
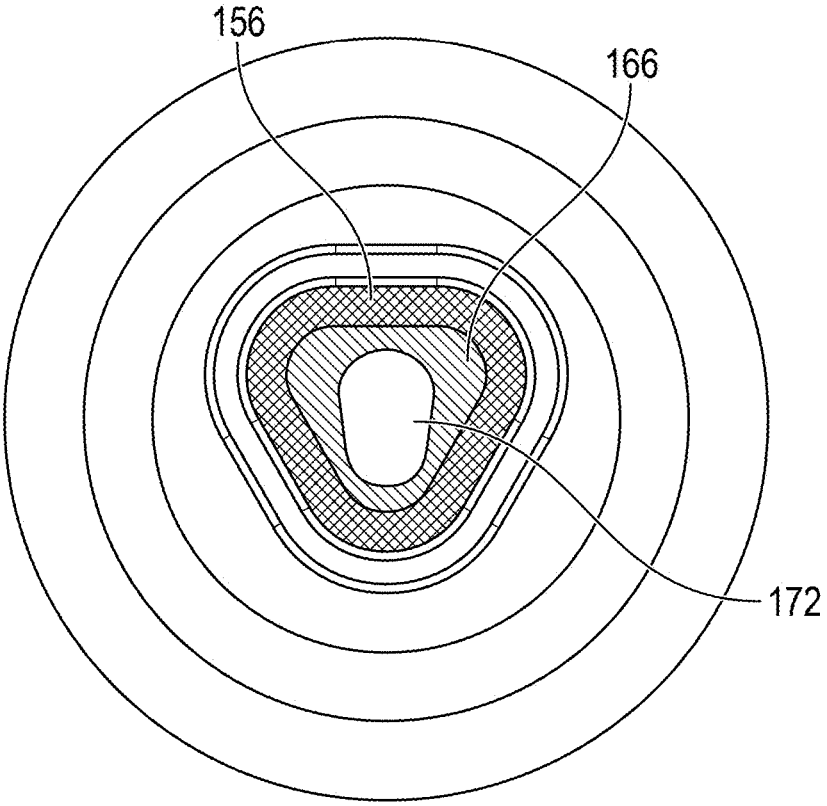

FIG. 17E depicts a bendable pole 102 with a three-sided flex-shell 166. Three-sided flex-shell 166 has a comfort cover 156 that takes on the shape of the three-sided flex-shell 166.

Although comfort cover 156 may take on the shape of the outer surface of flex-shell 156, it may not be as angular as flex-shell 156 because of the nature of its material, such as a closed cell polyurethane foam.

Various cores 172, such as described herein, may be incorporated into the multi-sided bendable bar 102. These variations in core and flex-shell shape can introduce effort differentials in the main bending arc.

Figure 18:
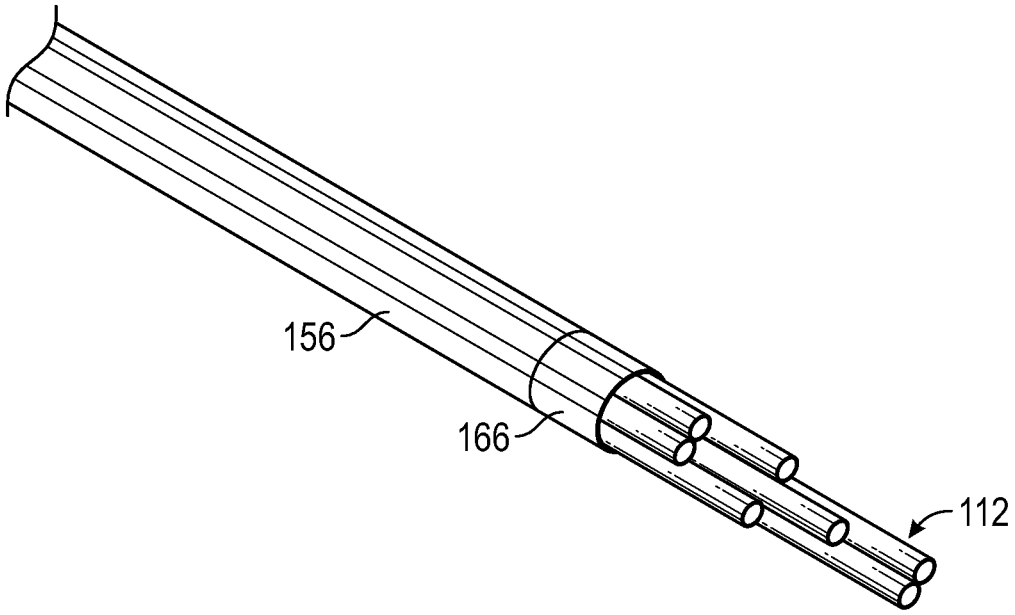
FIG. 18 depicts a cut-away image of a bendable pole showing a plurality of rods in a flex-shell.

FIG. 18 depicts a cut-away image of a bendable pole 102 showing rods 112 in a flex-shell 166 on which outer comfort cover 156 is disposed. Flex-shell 166 may be comprised of a solid polyurethane, for example. In illustrative embodiments it may be formed by an extrusion or casting process with a firmness density from 40 to 80 shore A durometer.

FIGS. 19A, 19B, 19C, 19D depict cross-sectional views of a bendable pole 102 having various core 172 profiles and showing rods 112 within the cores. The cross sections may be of the middle of bendable pole 102 or on either side of middle grip 108 such as through a line 17-17 shown in FIG. 17A. A cross-section taken through the middle of bendable pole 102 could be, for example, within the middle of a middle grip 108 such as shown in FIG. 1. Bendable pole 102 has core 172, around which mesh 174 is disposed. A sheath 176 is disposed around woven mesh 174. A comfort covering 156 may be positioned outside of sheath 176. Mesh 174 may be a woven material. Illustrative mesh 174 materials include PET (polyethylene terephthalate) braided loom material, BoPET (biaxially-oriented polyethylene terephthalate): also known as Mylar®, or other polyester film made from PET. Sheath 176 may be, for example, a PVC layer that may be clear or opaque. A design element may be introduced onto bendable pole 102 by using a decorative mesh 174, or other design attribute that is visible through a clear sheath 176. Information material and branding may also be provided within sheath 176. Sheath 176 may be shrink-wrapped onto mesh 174.

Figure 19A:
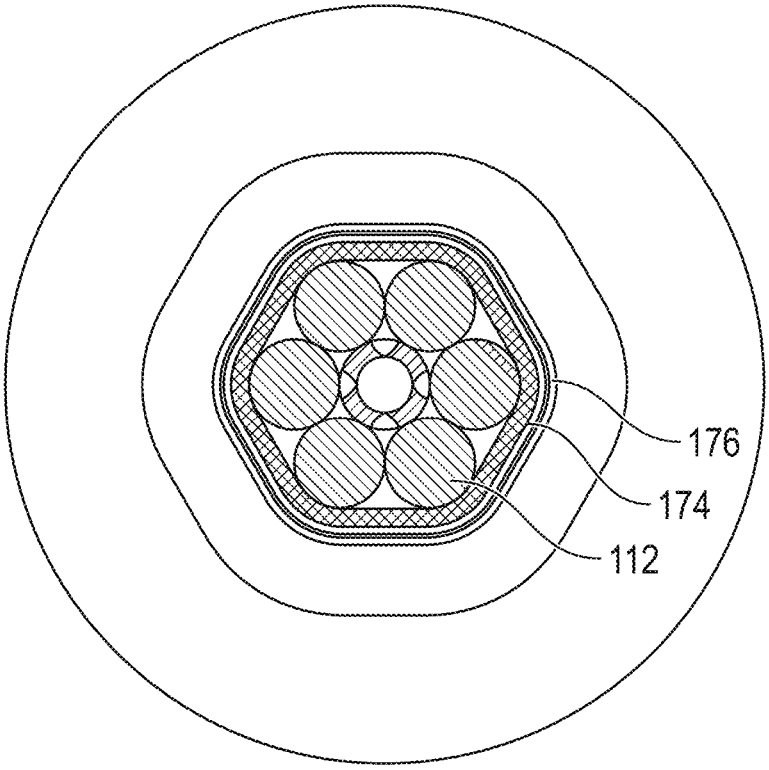
FIGS. 19A, 19B, 19C, 19D depict cross-sectional views of bendable poles having cores of various shapes, showing rods within the cores.
Figure 19B:
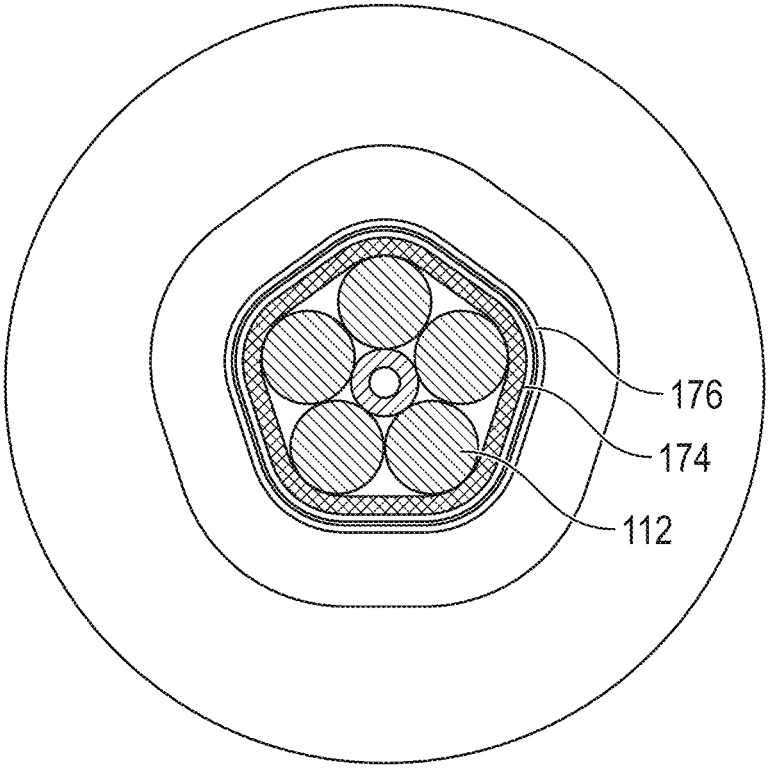
Figure 19C:
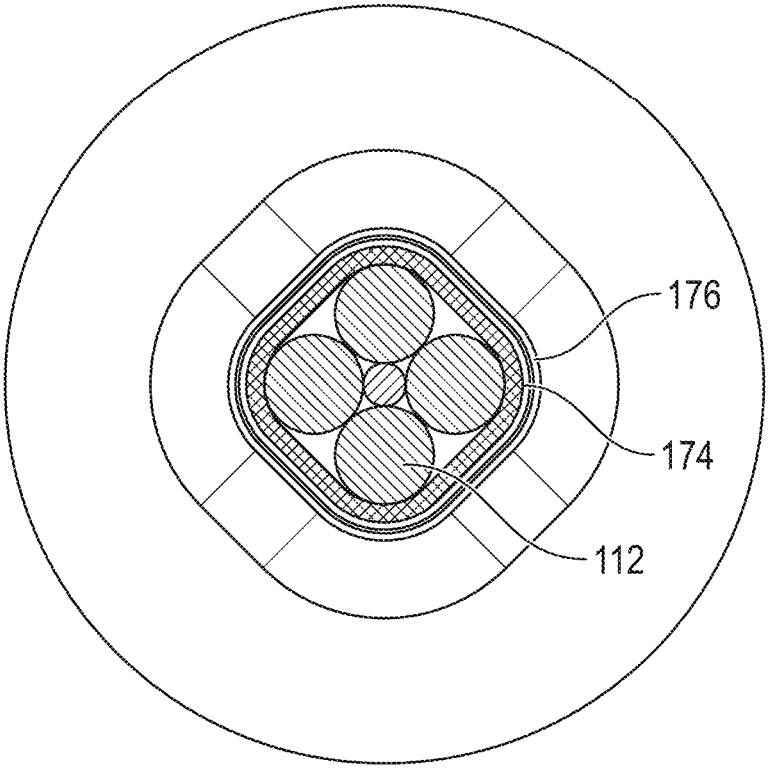
Figure 19D:
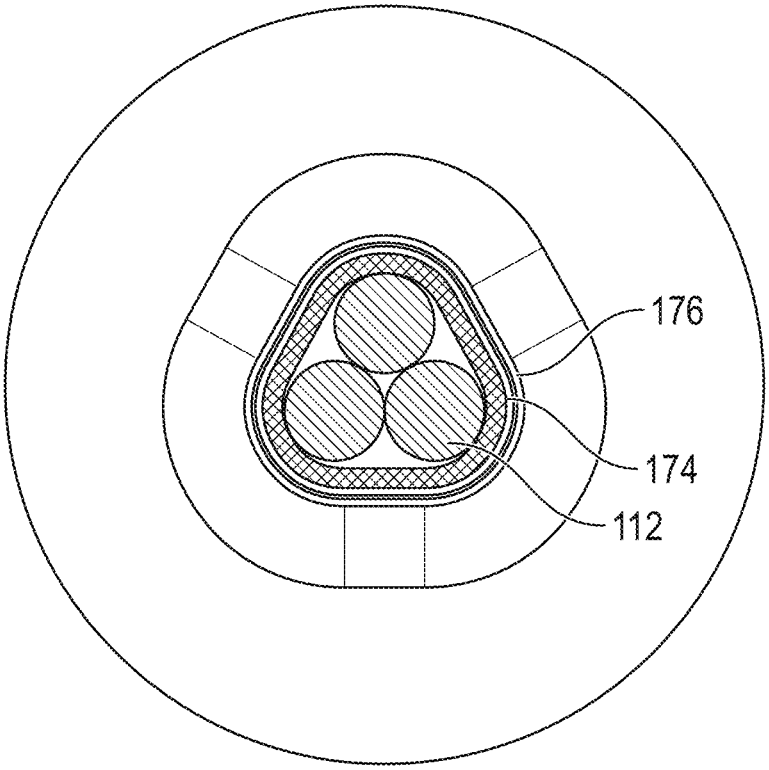

FIG. 19A depicts a six-sided bendable pole 102 with six rods 112 within core 172. FIG. 19B depicts a five-sided bendable pole 102 with five rods 112 within core 172. FIG. 19C depicts a four-sided bendable pole 102 with four rods 112 within core 172. FIG. 19D depicts a three-sided bendable pole with three rods 112 within core 172. In each of these illustrative embodiments, rods 112 substantially fill core 172.

Figure 21:
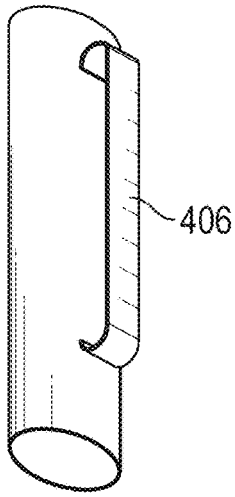
FIG. 21 depicts a storage/travel bag for carrying disassembled exercise devices.
Figure 20A:
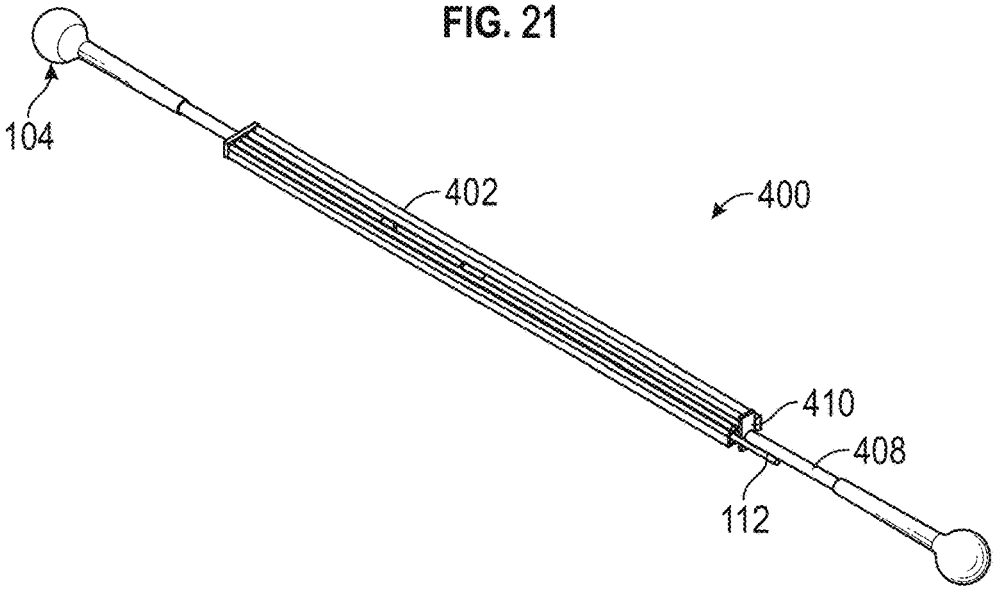
FIGS. 20A, 20B, 20C depict an exercise device wherein rods 112 are contained in a cassette.
Figure 20B:
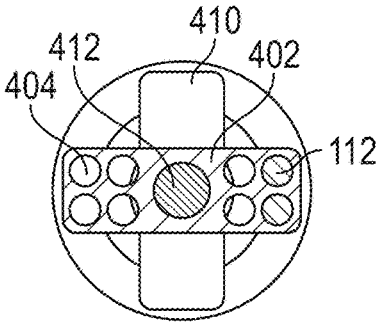
Figure 20C:
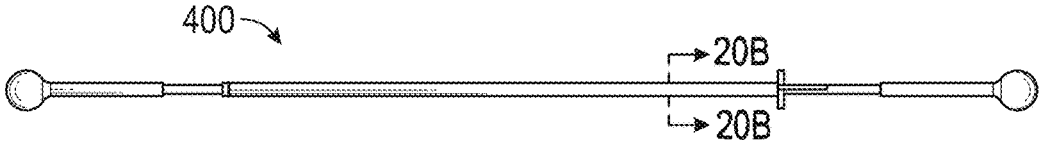

FIG. 20A depicts an exercise device 400 wherein rods 112 are contained in a cassette 402. FIG. 20B is a cross-section of exercise device 400 as taken through line 20B-20B on FIG. 20C. Cassette 402 contains multiple cores 404 into which rods 112 may be inserted or removed. In an illustrative embodiment, rods 112 may be inserted or removed by a user. In a further embodiment, rods 112 are permanently secured in cassette 402. Additionally, exercise device 400 may be disassembled by a user for storage or transport. A storage/travel bag 406 may be provided as illustrated in FIG. 21. A comfort cover 156 may be disposed around cassette 402, and may also span additional parts of exercise device 400. It is noted that various features of exercise device 100 described herein may also be a part of exercise device 400. The primary difference between exercise device 100 and exercise device 400 is that rods 112 of exercise device 400 are contained in a cassette 402. Therefore, all components described with respect to exercise device 100 may be implemented in exercise device 100 provided they are compatible with the cassette configuration.

In an illustrative embodiment, cassette 402 may hold up to eight rods 112 in cores 404, which may be configured as cylindrical openings. In an exemplary embodiment, rods 112 are 5/16 inch diameter rods, which may be constructed of FRP, for example. Cassette 402, may be, for example, a bendable polyurethane or other flexible plastic material.

Exercise device 400 has a cassette port cover 410 that covers the openings of cores 404 to retain rods 112. Cassette port cover 410 may be configured in any form that retains rods 112 in cores 404, and if user modification of rods is available, also is releasably attached or adjustable.

In an illustrative embodiment, effort levels may be modified by having no rods 112 inserted into cassette 402, or having one to eight rods 112 inserted, which modifies effort levels from approximately 80 to 100 lbs of force to bend the HD or HDX through the a standard range of motion equal to bending to a 24 inch opening of a u-shaped bendable pole. The particular diameter and material of rods 112 will have an effect on forces achieved.

Cassette 402 may be attached to grip end shafts 408. Grip end shaft 408 fits through cassette shaft opening 412. In an illustrative embodiment, grip end shafts may be 3/8 inch diameter stainless steel. Other materials with suitable strength and ability to be securely attached to adjacent components may be used.

FIGS. 22A-22E depict a portion of an exercise device 500 having a spring 502 in bendable pole 102 to further bias bendable pole 102 against a user bringing the exercise device ends toward one another. Exercise device 500 may have any of the features described with respect to exercise devices 100. The primary difference between exercise device 100 and exercise device 500 is that the means for producing various bending forces in exercise device 500 includes spring 502. Therefore, all components described with respect to exercise device 100 may be implemented in exercise device 100 provided they are compatible with the spring mechanism.

Figure 22A:
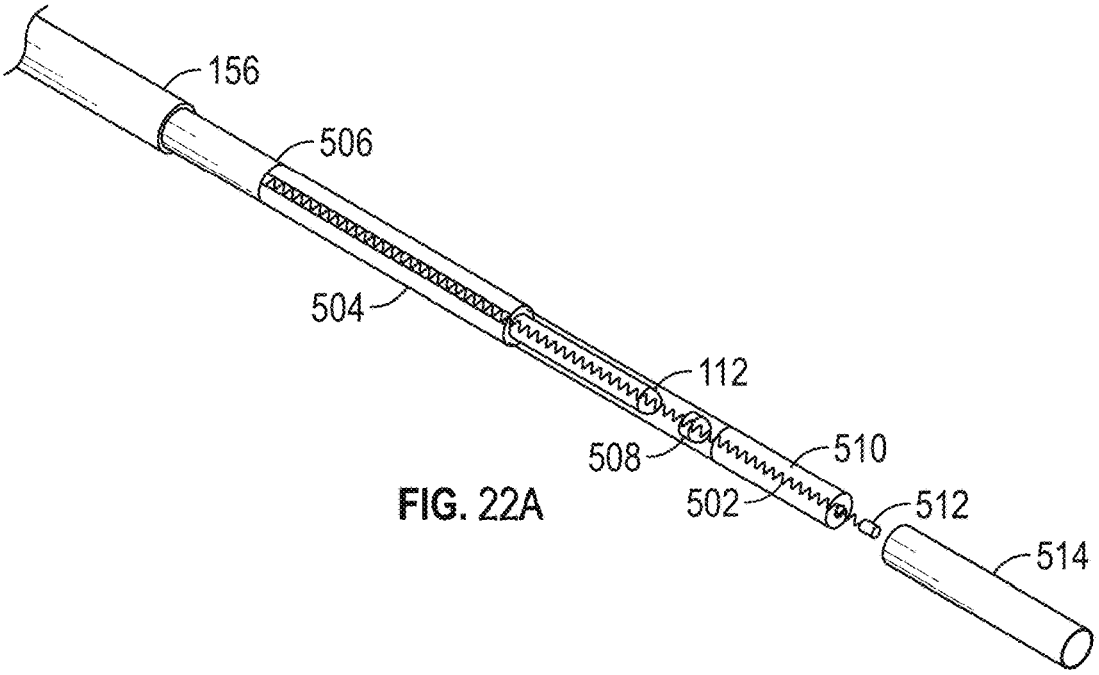
FIGS. 22A, 22B, 22C, 22D, 22E depict a portion of an exercise device having a sinusoidal spring in the bendable pole to create bending or spring forces.
Figure 22C:
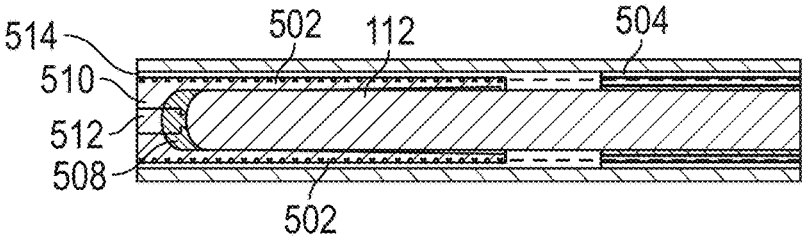
Figure 22B:
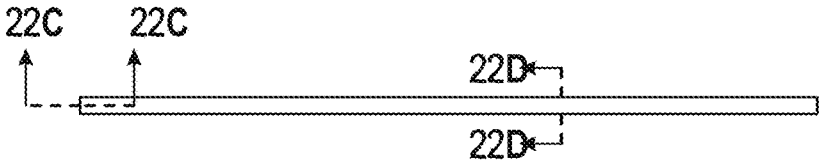
Figure 22D:
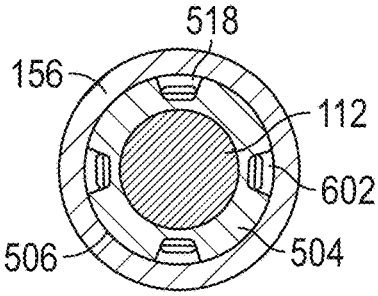
Figure 22E:
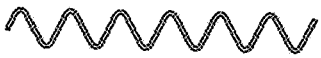

FIG. 22A depicts a cut-away view of exercise device 500. FIG. 22B indicates locations of cross-section views 22C-22C and 22D-22D. FIG. 22C is the cross-sectional view through line 22C-22C, and FIG. 22D is the cross-sectional view through line 22D-22D. FIG. 22E depicts an illustrative spring 502, which in this illustration is a sinusoidal spring.

In an illustrative embodiment, bendable pole 102 has one or more springs 502 disposed longitudinally along bendable pole 102. A spring spline 504 contains spring(s) 502 wherein the peaks of a sinusoidal spring are positioned within grooves of spring spline 504. A tube 506 is disposed around spring spline 504. Tube 506 may be, for example, a heat-shrink material, such as PVC. In an illustrative embodiment, tube 506 covers the entire length of exercise device 100. The spring spline 504 holds springs 502 in their general orientation around the bar providing a relaxed fit for each spring. If four springs are present, three are not under tension load during a bend; only the spring on the outside or near the outside of a bend develops tension during a bend. The one spring toward the inside would buckle slightly while the ones on the sides of a bend will bend without developing tension.

In an exemplary embodiment, a single rod 112 extends within tube 504 so that spring 502 is positioned between rod 112 and tube 504. A bushing 508 is within a tube 516 between rod 112 and spring attachment component 510. A set screw 512 is attached to spring 502 and engages with threads in spring attachment component 510. A sleeve 514 covers spring attachment component 510, all or a portion of set screw 512, bushing 508 and a portion of spring 502 and rod 112. A comfort cover 156 may be disposed over sleeve 514.

The spring attachment component 510 has shaped notches that match up with the steps of the springs wave form holding springs 502 in place for developing tension over the outside of a bend.

When set screw 512 is tightened by moving it within spring attachment 510 toward bushing 508, the cumulative tension of spring(s) 502 is increased. This increases the base line bending arc effort. If all springs 502 have the same tension value then the main bending arc force of bendable pole 102 will be equal, regardless of the position of end grips 104A, 104B in the user's grip. Only the springs that are oriented toward the outside of the main bending arc during a bend contribute to bendable pole 102's effort range. Tension of spring(s) 102 along the outside of the bending arc is added to the force of the single rod 112.

In an illustrative embodiment, bendable pole 102 includes four springs 502. A user may experience up to four distinctly different effort levels by rotating the end grips 104A, 104B within their grip. A user may feel the differential in effort levels by rotating bendable pole in approximate 90 degree increments. Rotation need not be in precise 90 degree increments to experience the differential. When the bendable pole 102 is equipped with two springs 502 substantially equal in low effort, disposed at 180 degrees apart and two springs 502 that are equal in high effort in the remaining groves, bendable pole 102 will have two very distinct effort levels when turned every 90 degrees. The greater the difference in spring effort, the greater is the difference in the effort felt by the user in bending the bar.

Figure 23B:
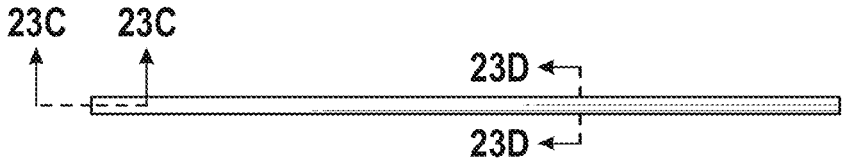
FIGS. 23A, 23B, 23C, 23D, 23E depict a portion of an exercise device having a music wire in the bendable pole to create bending or spring forces.
Figure 23A:
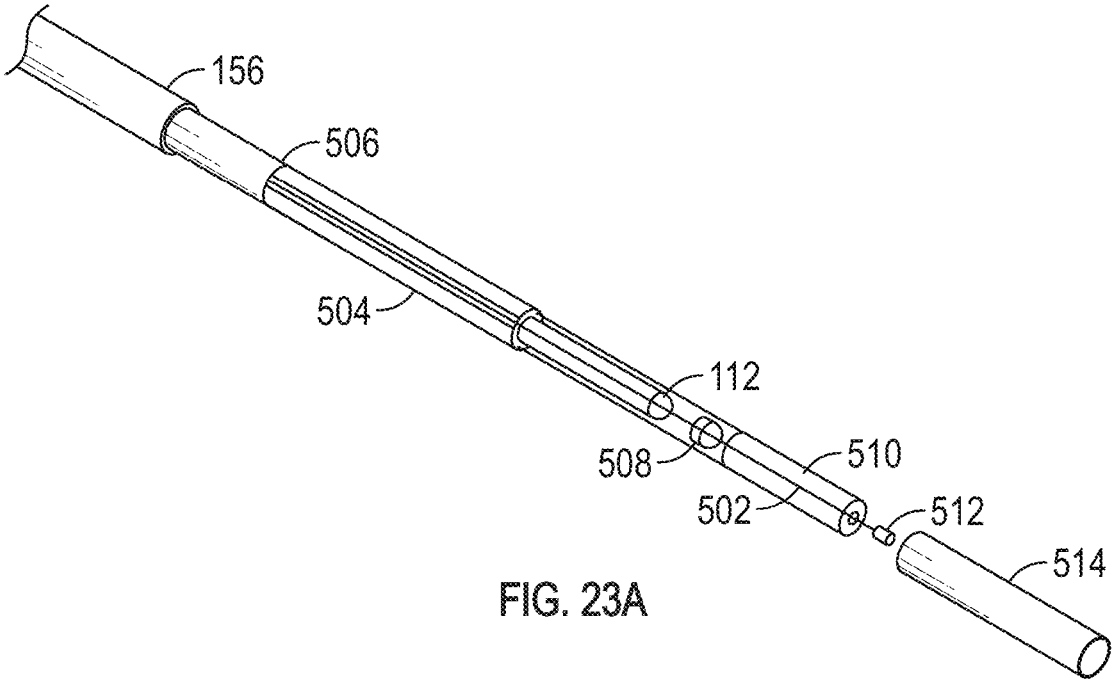
Figure 23D:
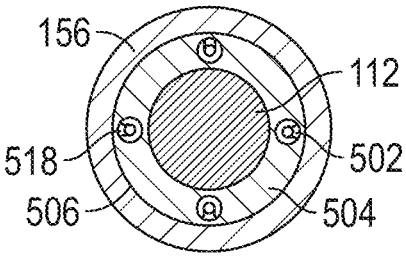
Figure 23C:
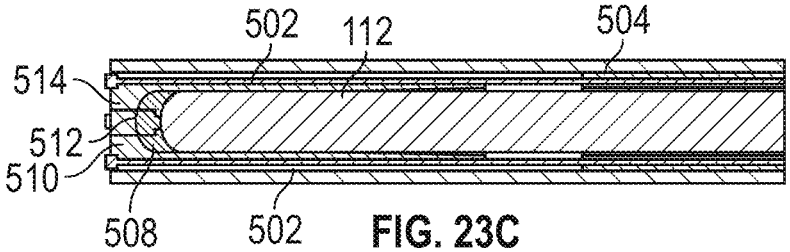
Figure 23E:
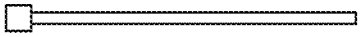

FIGS. 23A-23E depict exercise device 500 in which spring 502 is a music wire spring, such as shown in FIG. 23E. It is noted that spring 502 is not limited to either a sinusoidal or music wire spring, but may be other elastic components that provide tension compatible with the exercise device and its intended use. FIG. 23A depicts a cut-away view of exercise device 500. FIG. 23B indicates locations of cross-section views 23C-23C and 23D-23D. FIG. 23C is the cross-sectional view through line 23C-23C. FIG. 23D is the cross-sectional view through line 23D-23D. FIG. 23E depicts an illustrative spring 502 in the form of a music wire spring. The general components and operation of exercise device 500 shown in FIGS. 23A, 23B, 23C and 23D are analogous to that shown in FIGS. 22A, 22B, 22C and 22D, except spring 502 is a music wire spring instead of a sinusoidal spring.

Figure 26A:
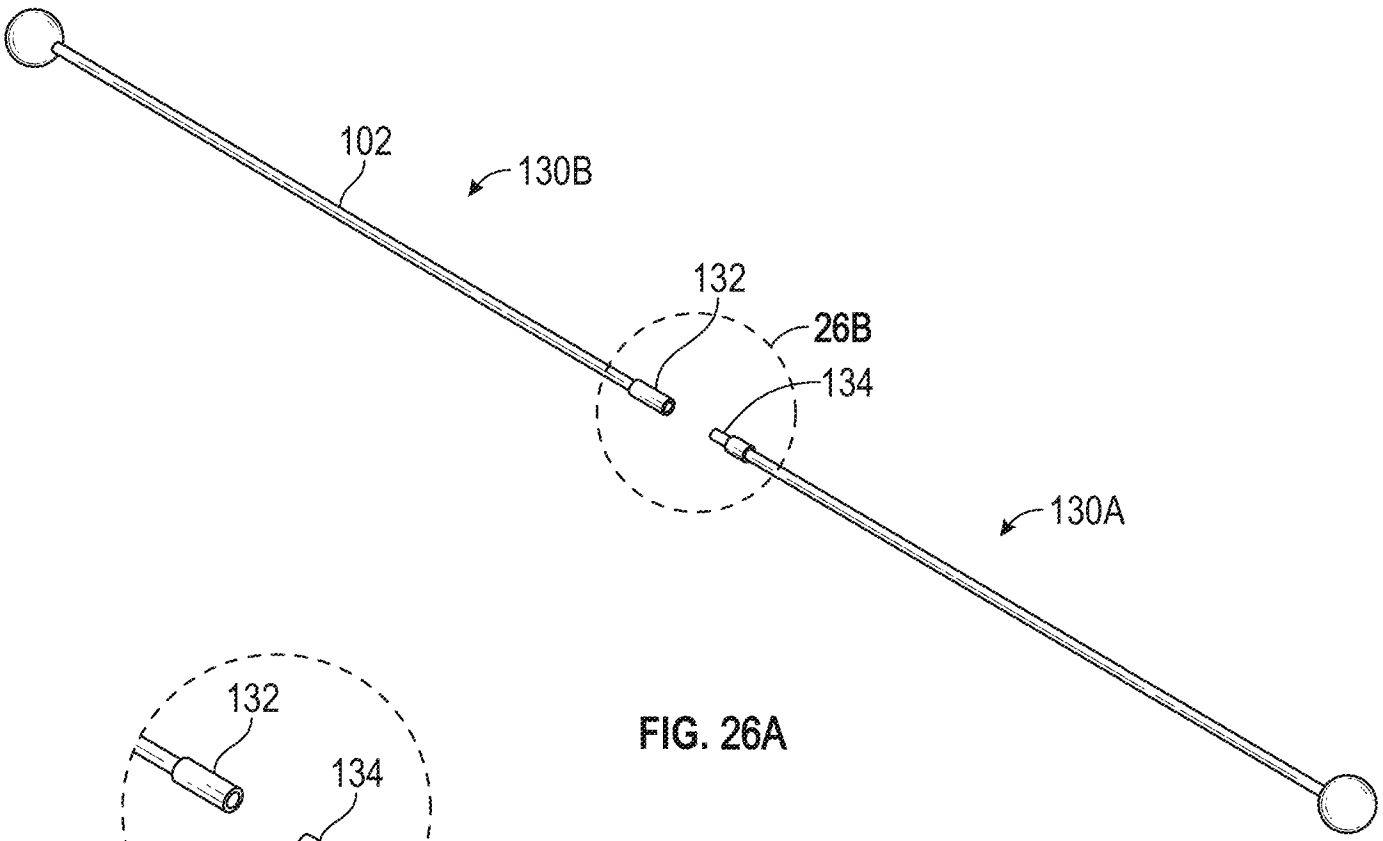
FIGS. 26A, 26B depict an exercise device that can be separated into two or more pieces for compact storage and travel.
Figure 26B:
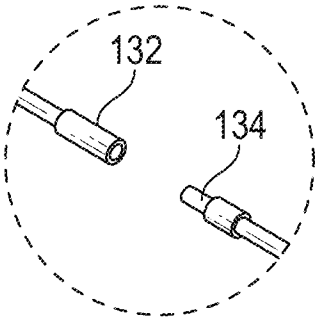

FIGS. 26A, 26B depict an embodiment of exercise device 100 that can be separated into two or more pieces for compact storage and travel. The particular embodiment shown in FIG. 26A separates bendable pole 102 into two section 130A, 130B at the center of bendable pole 102. FIG. 26B is a close up of the attachment mechanism. Bendable pole sections 130A, 130B may screw together, be secured to one another by a bayonet 1/4 or 1/2 turn insert and twist with a spring lock pin, or twist collet within an outer flex tube, for example. In an illustrative embodiment, bendable pole sections 130A, 130B have a first fitting 132 and a second fitting 134, which together provide a bayonet connection or screw-type connection, for example. Any connection mechanism that is durable enough to withstand flexing of bendable pole 102 and can be releasably connected may be used. The connection must also not interfere with use and comfort of use of exercise device 100.

Figure 27:
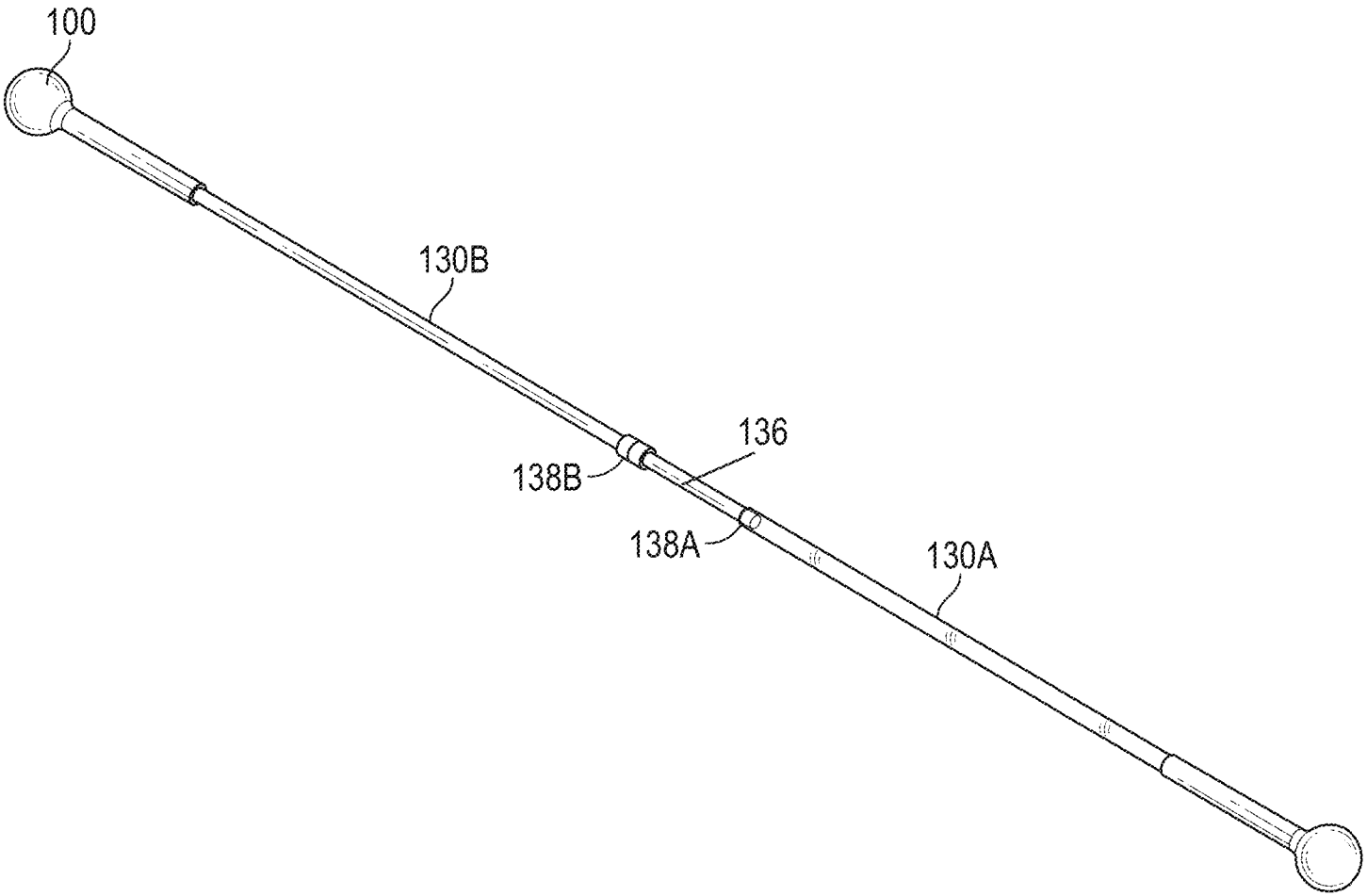
FIG. 27 depicts an exercise device having a releasably attachable bendable pole wherein the bendable pole has two sections that connect through a flexible tube.

FIG. 27 depicts a further embodiment of exercise device 100 having a releasably attachable bendable pole 102. Bendable pole 102 has two sections 130A, 130 B that connect through a flexible tube 136, preferably of substantially equal bending modulus. Flexible tube 136 allows a slide together adjustable length with twist locking to hold the length position. Bendable pole sections 130A, 130B are connected with an internal, expanding collet. Flexible tube 136 may have reinforcement collars 138A, 138B. In an illustrative example, flexible tube collars 138A, 138B comprise reinforced PVC tubing, such as spiral reinforced tubing with a thickness of about ⅛ inch.

Figure 28:
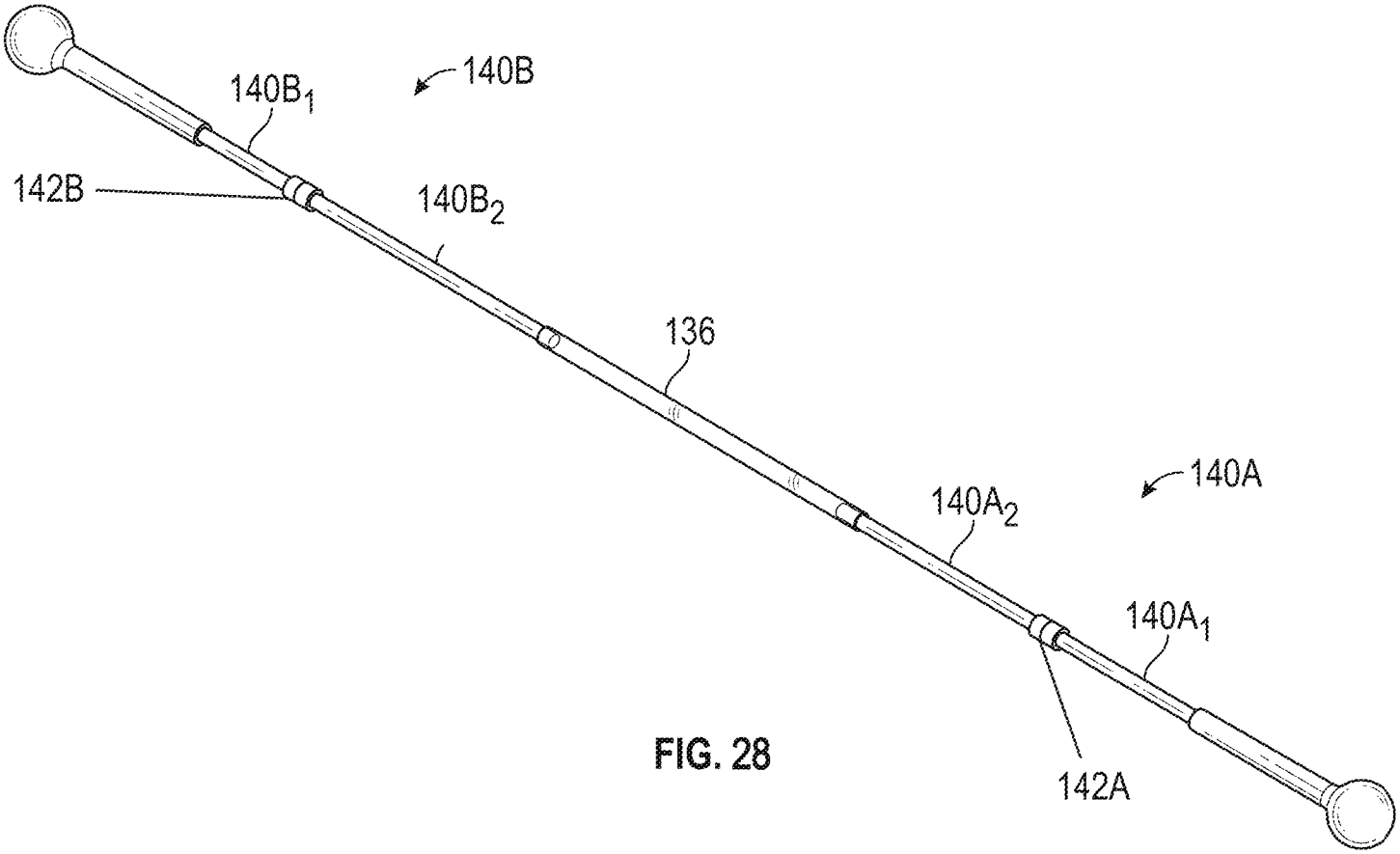
FIG. 28 depict a bendable pole with multiple releasably attached sections.

As shown in FIG. 28 bendable pole 102 may have three sections: bendable pole sections 140A, 140B, and flexible tube 136. Bendable pole sections 140A, 140B each comprise a first segment 140$A_1$, 104$B_1$ and a second segment 140$A_2$, 140$B_2$, respectively. Flexible tube 136 engages with bendable pole segments 140$A_2$, 140$B_2$ at each of its ends and allows a slidable adjustment at each of those locations. Bendable pole segments 140$A_1$ and 140$A_2$ are releasably connected to one another. Bendable pole segments 140$B_1$ and 140$B_2$ are releasably connected to one another. Thus, there are three releasably connected sections, releasably connected at points 142A and 142B, forming bendable pole 102.

In a further illustrative embodiment, exercise device 100 is constructed as a mono element that provides a similar range of motion and effort levels.

The spacer may be a die formed plastic or copolymer extrusion with seven channels sized to contain the six rods in a hexagonal pattern and includes the optionally utilized center seventh channel position.

For example. one or more of the following features may be incorporated into the exercise device:

wireless personal fitness tracking with a mobile app;

IMU (Inertial Measurement Unit) motion sensor—tracks acceleration, speed and position as part of an interactive program of exercises, movements and positions;

Strain Gauge Sensors (Bend Measurement)—tracks effort, degree of bend and provides power used or calories burned;

LED lights: Light show, provide Prompts, Tempo, provide Feedback to App Program, respond to external Audio, or synchronize with external devices (cellphone app, Headsets or other Bend Bars);

RF (Bluetooth module)—for data sync; and

Speakers provide music or recorded program prompts.

Exercise device 100 may provide a safety advantage over other exercise devices. For example, end grips 104 provide a cushioned end that may be safer than a rigid end piece of exercise device 100. The composition of end grip 104, provides a safety element when comprised of urethane integral skin outer, for example to resist penetration from outside or inside. A soft shock adsorbing inner foam zone adds to safety by being designed to reduce the possibility of accidental or intentional injury to the user or any other person's head or other body areas or property in the vicinity of use. This allows use of exercise device 100 within a group class in close proximity.

End grip 104 is configured to remain fixed to bendable pole 102 during use, and even misuse, thereby avoiding exposure of hard or pointed items inside. The firmly attached end grip 104 may add to the dynamic use of the bar by imparting torque potential end to end. This adds character and quality to the various ways exercise device 100 can be used in many individual or group settings.

Further safety features may include, the spacer or other covering being impervious and non-toxic, with the ability to sanitize it with strong cleaning or disinfecting solutions without significant long-term degradation in commercial high use fitness club or school gym environments.

Various embodiments of the invention have been described, each having a different combination of elements. The invention is not limited to the specific embodiments disclosed, and may include different combinations of the elements disclosed, omission of some elements or the replacement of elements by the equivalents of such structures. Each of exercise devices 100, 400, 500 may include any combination of various elements, such as end grips, middle grips, different materials, electronic components and other layer or components that could apply to any of those embodiments. Exercise devices 100, 400, 500 differ mainly in that exercise device 400 has a cassette configuration to impart the bending and resiliency characteristics, and exercise device 500 has one or more springs for that purpose. Exercise devices 100, such as those described with rods 112 or hollow cores also can have any combination of the various elements described herein.

While the invention has been described by illustrative embodiments, additional advantages and modifications will occur to those skilled in the art. Therefore, the invention in its broader aspects is not limited to specific details shown and described herein. Modifications, for example, to dimensions and materials, and incorporation of equivalent components, may be made without departing from the spirit and scope of the invention. Accordingly, it is intended that the invention not be limited to the specific illustrative embodiments, but be interpreted within the full spirit and scope of the appended claims and their equivalents.

The invention claimed is:

1. An exercise device comprising:

a bendable pole having a resilient mechanism having a plurality of flexible rods contained within the bendable pole;

a first end grip disposed on a first end of the pole;

a second end grip disposed on a second end of the pole;

a middle grip disposed in a mid-section of the pole; and a core having asymmetrical major axis and minor axis diameters within the bendable pole, wherein the plurality of rods are slideable against one another within the core to accommodate relative movement of the rods when the pole is bent.

2. The exercise device of claim 1 wherein the bendable pole resilient mechanism comprises:

a spline having grooves, the spline disposed within the bendable pole; and one or more springs disposed in the spline grooves.

3. The exercise device of claim 1 wherein the plurality of rods maintain engagement with the first end grip and the second end grip when the pole is bent.

4. The exercise device of claim 1 wherein at least a part of the middle grip is adjustably attached to the pole.

5. The exercise device of claim 1 wherein one or more of the first end grip, the second end grip, the middle grip and the bendable pole have a hollow interior section with electronics disposed therein.

6. The exercise device of claim 5 further comprising lighting and/or audio.

7. The exercise device of claim 1 further comprising sensors to obtain or provide one or more of: health-related data, information on movement and positions, calories burned, and other exercise-related information.

8. The exercise device of claim 7 further comprising one or more sensors to measure an amount of work and peak efforts of a user.

9. The exercise device of claim 8 in which the sensor is in the form of a conductive plastic material.

10. The exercise device of claim 9 wherein one or both of the end grips comprise the conductive plastic.

11. The exercise device of claim 1 further comprising a motorized massage assembly.

12. The exercise device of claim 1 further comprising an electronic addition coordinated with a downloadable mobile software application comprising:

a sensor for translating mechanical forces into a variable voltage that represents an amount of work effort exerted by a user, the variable voltage generating a proportional signal;

a software application having executable code to carry out a method comprising:

receiving the signal;

converting the signal to a bending force equivalent; and displaying or storing the bending force equivalent.

13. The exercise device of claim 12 wherein the method further comprises:

calibrating the work effort to the exercise device in use.

14. The exercise device of claim 12 wherein the electronic addition tracks one or more of the following: maximum effort, time per cycle, averages over time, total times, and number of repetitions.

15. A non-transitory computer readable medium including software instructions for performing a method comprising:

receiving a signal from a sensor for translating mechanical forces generated by bending a pole of an exercise device into a variable voltage that represents an amount of work effort exerted by a user to bend the exercise device, wherein the variable voltage generates a proportional signal;

converting the signal to the bending force equivalent; and displaying or storing the bending force equivalent.

16. An exercise device comprising:

a bendable pole having a resilient mechanism;

a first end grip disposed on a first end of the pole;

a second end grip disposed on a second end of the pole;

a middle grip disposed in a mid-section of the pole;

one or more of the first end grip, the second end grip, the middle grip and the bendable pole having a hollow interior section with electronics disposed therein; and an electronic addition coordinated with a downloadable mobile software application having a sensor for translating mechanical forces generated by bending the bendable pole into a variable voltage that represents an amount of work effort exerted by a user to bend the bendable pole, the variable voltage generating a proportional signal.

* * * * *